US011422510B2

(12) United States Patent
Tombez

(10) Patent No.: US 11,422,510 B2
(45) Date of Patent: Aug. 23, 2022

(54) TIMEPIECE COMPRISING A MECHANICAL OSCILLATOR ASSOCIATED WITH A REGULATION SYSTEM

(71) Applicant: The Swatch Group Research and Development Ltd, Marin (CH)

(72) Inventor: Lionel Tombez, Bevaix (CH)

(73) Assignee: The Swatch Group Research and Development Ltd, Marin (CH)

( * ) Notice: Subject to any disclaimer, the term of this patent is extended or adjusted under 35 U.S.C. 154(b) by 922 days.

(21) Appl. No.: 16/220,232

(22) Filed: Dec. 14, 2018

(65) Prior Publication Data

US 2019/0187623 A1 Jun. 20, 2019

(30) Foreign Application Priority Data

Dec. 20, 2017 (EP) ..... 17209121

(51) Int. Cl.
*G04C 3/06* (2006.01)
*G04G 19/06* (2006.01)
(Continued)

(52) U.S. Cl.
CPC ..... *G04C 3/068* (2013.01); *G04B 17/06* (2013.01); *G04C 3/04* (2013.01); *G04C 10/00* (2013.01); *G04G 19/06* (2013.01)

(58) Field of Classification Search
CPC .. G04C 3/04–069; G04C 10/00; G04B 17/06; G04G 19/06
See application file for complete search history.

(56) References Cited

U.S. PATENT DOCUMENTS 3,124,731 A * 3/1964 Eysen et al. ..... G04C 3/068 318/132
3,407,344 A * 10/1968 Bansho ..... G04C 3/069 318/130

(Continued)

FOREIGN PATENT DOCUMENTS

EP 1 241 538 A1 9/2002

OTHER PUBLICATIONS

European Search Report dated May 25, 2018 in European Application 17209121.7, filed on Dec. 20, 2017 (with English Translation of Categories of Cited Documents).

*Primary Examiner* — Daniel P Wicklund
(74) *Attorney, Agent, or Firm* — Oblon, McClelland, Maier & Neustadt, L.L.P.

(57) ABSTRACT

A timepiece includes a mechanical movement with a mechanical oscillator and an electronic device for regulating the medium frequency of this mechanical oscillator. It includes an electromagnetic transducer and an electric converter which includes a primary storage unit for powering the regulation circuit. The electromagnetic transducer is arranged to supply a voltage signal exhibiting first voltage lobes in first half-alternations and second voltage lobes in second half-alternations of the oscillations of the mechanical oscillator. The regulating device includes a load pump arranged to transfer electric loads from the primary storage unit into a secondary storage unit, these electric loads being extracted selectively in different time zones according to a time drift detected in the functioning of the mechanical oscillator relative to an auxiliary oscillator, particularly quartz-based.

22 Claims, 15 Drawing Sheets

(51) Int. Cl.

| | |
|---|---|
| ***G04C 10/00*** | (2006.01) |
| ***G04B 17/06*** | (2006.01) |
| ***G04C 3/04*** | (2006.01) |

(56) References Cited

U.S. PATENT DOCUMENTS

| | | | | |
|---|---|---|---|---|
| 3,568,431 | A * | 3/1971 | Schaad | G04C 3/06 368/169 |
| 3,803,829 | A * | 4/1974 | Tsuruishi | G04C 3/067 368/158 |
| 2013/0051191 | A1 | 2/2013 | Schafroth | |
| 2018/0181073 | A1 * | 6/2018 | Tombez | G04C 9/08 |

* cited by examiner

TIMEPIECE COMPRISING A MECHANICAL OSCILLATOR ASSOCIATED WITH A REGULATION SYSTEM

CROSS-REFERENCE TO RELATED APPLICATION

This application claims priority to European Patent Application No. 17209121.7 filed on Dec. 20, 2017, the entire disclosure of which is hereby incorporated herein by reference.

TECHNICAL FIELD

The present invention relates to a timepiece comprising a mechanical oscillator associated with a system for regulating the medium frequency thereof. The regulation is of the electronic type, i.e. the regulation system comprises an electronic circuit connected to an auxiliary oscillator which is arranged to supply a high-precision electric clock signal. The regulation system is arranged to correct a potential time drift of the mechanical oscillator relative to the auxiliary oscillator.

In particular, the mechanical oscillator comprises a mechanical resonator formed by a balance-spring and a maintenance device formed by a conventional escapement, for example having Swiss pallets. The auxiliary oscillator is formed particularly by a quartz resonator or by a resonator integrated in the electronic regulation circuit.

TECHNOLOGICAL BACKGROUND

Movements forming timepieces as defined in the field of the invention have been proposed in some prior documents. The patent CH 597 636, published in 1977, proposes such a movement with reference to FIG. 3 thereof. The movement is equipped with a resonator formed by a balance-spring and a conventional maintenance device comprising pallets and an escapement wheel kinematically linked with a barrel equipped with a spring. This timepiece movement comprises a system for regulating the frequency of the mechanical oscillator. This regulation system comprises an electronic circuit and an electromagnetic assembly formed from a flat coil, arranged on a support arranged under the felloe of the balance, and from two magnets mounted on the balance and arranged close to one another so as to both pass over the coil when the oscillator is activated.

The electronic circuit comprises a time base comprising a quartz generator and serving to generate a reference frequency signal FR, this reference frequency being compared with the frequency FG of the mechanical oscillator. The frequency FG of the oscillator is detected via the electrical signals generated in the coil by the pair of magnets. The regulation circuit is suitable for momentarily inducing a braking torque via a magnetic magnet-coil coupling and a switchable load connected to the coil. The document CH 597 636 provides the following teaching: "The resonator formed should have a variable oscillation frequency according to the amplitude on either side of the frequency FR (isochronism error)". It is therefore taught that a variation in the oscillation frequency of a non-isochronous resonator is obtained by varying the oscillation amplitude thereof. An analogy is made between the oscillation amplitude of a resonator and the angular velocity of a generator comprising a rotor equipped with magnets and arranged in a geartrain of the timepiece movement in order to regulate the running thereof. As a braking torque reduces the rotational speed of such a generator and thus the rotational frequency thereof, it is herein merely envisaged to be able to reduce the oscillation frequency of an obligatorily non-isochronous resonator by applying a braking torque reducing the oscillation amplitude thereof.

To perform electronic regulation of the frequency of the generator, or of the mechanical oscillator, it is envisaged in a given embodiment that the load is formed by a switchable rectifier via a transistor which loads a storage capacitor during braking pulses, to retrieve the electrical energy so as to power the electronic circuit. The consistent teaching given in the document CH 597 636 is as follows: When FG>FR, the transistor is conductive; a power Pa is then drawn from the generator/oscillator. When FG<FR, the transistor is non-conductive; therefore, power is no longer drawn from the generator/oscillator. In other words, regulation is merely performed when the frequency of the generator/of the oscillator is greater than the reference frequency FR. This regulation consists of braking the generator/oscillator with the aim of reducing the frequency FG thereof. Thus, in the case of the mechanical oscillator, those skilled in the art understand that regulation is only possible when the barrel spring is strongly armed and that the free oscillation frequency (natural frequency) of the mechanical oscillator is greater than the reference frequency FR, resulting from a voluntary isochronism error of the selected mechanical oscillator. Therefore, there is a two-fold problem, i.e. the mechanical oscillator is selected for that which is usually an error in a mechanical movement and the electronic regulation is only functional when the natural frequency of this oscillator is greater than a nominal frequency.

The patent application EP 1 521 142 also relates to the electronic regulation of a balance-spring. The regulation system proposed in this document is similar in the general functioning thereof to that of the patent CH 597 636.

The patent application EP 1 241 538 teaches that the braking moment of the mechanical oscillator, during an alternation (i.e. half-period or half cycle) of any oscillation thereof, makes it possible either to reduce the value of the current oscillation period, or increase same. To do this, an electromagnetic magnet-coil assembly and a control circuit which is arranged to render the coils conductive or not during certain defined time intervals is provided. As a general rule, braking of the mechanical oscillator, by generating an electric power in the coils during magnet-coil coupling, during an oscillation period gives rise either to an increase in the corresponding period when this braking occurs prior to the passage of the mechanical resonator via the neutral point thereof (rest position), or to a decrease in the corresponding period when this braking occurs after the passage of the mechanical resonator via the neutral point thereof.

In relation to the implementation of an electronic regulation making use of the above-mentioned observation, the document EP 1 241 538 proposes two embodiments. In these two embodiments, a piezo-electric system is provided associated with the escapement to detect tipping of the pallets thereof in each oscillation period. By means of such a detection system, it is envisaged, on one hand, to compare the oscillation period with a reference period, defined by a quartz oscillator, to determine whether the running of the timepiece exhibits a gain or a loss and, on the other, to determine in one alternation out of every two the passage of the mechanical oscillator via the neutral point thereof. In the first embodiment, according to whether the time drift corresponds to a gain or a loss, it is envisaged to render the coils conductive for a certain time interval respectively before or after the passage via the neutral position of the mechanical oscillator in an alternation. In other words, it is envisaged herein to short-circuit the coils before or after the passage via the neutral position according to whether the regulation requires respectively an increase or a decrease of the oscillation period.

In the second embodiment, it is envisaged to power the regulation system by periodically drawing energy from the mechanical oscillator via the electromagnetic assembly. For this purpose, the coils are connected to a rectifier which is arranged to recharge a condenser (storage capacitor), which serves as a power supply source for the electronic circuit. The electromagnetic assembly is that given in FIGS. 2 and 4 of the document and the electronic circuit is represented schematically in FIG. 5 of this document. The only indications given for the functioning of the regulation system are as follows: 1) the coils are rendered conductive during constant time intervals which are centered on respective passages of the mechanical resonator (balance-spring) via the neutral position thereof (median alternation position); 2) during these time intervals, an induced current is rectified and stored in the condenser; and 3) during said time intervals, the oscillation period of the balance-spring may be regulated effectively by adjusting the value of the power generated by the induced current, without any further details being provided.

It may be considered that the choice of coil conduction intervals centered on the neutral positions of the mechanical resonator has the objective of not inducing a parasitic time drift in the mechanical oscillator by drawing energy therefrom to power the electronic circuit. By rendering the coils conductive for the same duration before and after the passage via the neutral position, the author maybe thinks to poise the effect of a braking preceding such a passage via the neutral position with the effect of a braking following this passage to thus not modify the oscillation period in the absence of a regulation circuit correction signal arising from the measurement of a time drift. One may have strong doubts that this is achieved with the electromagnetic assembly disclosed and a conventional rectifier connected to a storage capacitor. Firstly, the recharging of this storage capacitor is dependent on the initial voltage thereof at the start of a given time interval. Subsequently, the induced voltage and the induced current in the coils vary in intensity with the angular velocity of the balance-spring, this intensity decreasing on moving away from a neutral position where the angular velocity is maximum. The electromagnetic assembly disclosed makes it possible to determine the shape of the induced voltage/induced current signal. Although the angular position of the magnets relative to the coils for the neutral position (rest position) is not given and it is not possible to infer a teaching on the signal phase, it may be inferred that the recharging of the storage capacitor will usually take place mostly prior to the passage via the neutral position. Thus, a braking results therefrom which is not symmetrical relative to the neutral position and a parasitic loss in the running of the timepiece. Finally, as regards the adjustment of the induced power during the time intervals envisaged to regulate the running of the timepiece, no indications are given. One does not understand how such an adjustment is made, no teaching being given on this matter.

SUMMARY OF THE INVENTION

A general aim, within the scope of the development resulting in the present invention, was that of producing a timepiece, comprising a mechanical movement with a mechanical oscillator and an electronic system for regulating this mechanical oscillator, for which it is not necessary to initially put the mechanical oscillator out of order to put it forward, in order to thus obtain a timepiece which has the precision of an auxiliary electronic oscillator (particularly equipped with a quartz resonator) when the regulation system is operational and, otherwise, the precision of the mechanical oscillator corresponding to the optimum setting thereof. In other words, it is sought to adjoin electronic regulation to a mechanical movement regulated as accurately as possible moreover such that it remains operational, with the best possible running, when the electronic regulation is inactive.

The first aim of the present invention is that providing a timepiece of the type described above and which is capable of correcting a loss or a gain in the time drift of the mechanical oscillator while making it possible to carry out self-powering of the regulation system effectively.

One particular aim is that of providing such a timepiece which is capable, for a defined electromagnetic assembly, of continuously or quasi-continuously supplying an electrical power supply voltage which remains above a power supply voltage which is sufficient to power the regulating device, independently of the regulation of the medium frequency of the mechanical oscillator, particularly of the electrical energy generated by the regulation, and therefore also in the absence of time drift correction (case where it remains low, or even zero).

A further particular aim is that of ensuring self-powering of the regulation system without inducing a parasitic time drift, in particular in the absence of time drift correction, or at least such that any such parasitic time drift remains minimal and negligible.

A further aim is that of using the electrical regulation energy to power an auxiliary function and therefore an auxiliary load, by storing this electrical energy effectively without giving rise to instability in the functioning of the regulating device or disturbance of regulation.

To this end, the present invention relates to a timepiece, comprising:

- a mechanism, particularly a time indication mechanism,
- a mechanical resonator suitable for oscillating about a neutral position corresponding to the minimal mechanical potential energy state thereof, each oscillation of the mechanical resonator defining an oscillation period and having two successive alternations each between two extreme positions which define the oscillation amplitude of the mechanical resonator, each alternation having a passage of the mechanical resonator via the neutral position thereof at a median time and consisting of a first half-alternation between an initial time of this alternation and the median time thereof and a second half-alternation between this median time and an end time of this alternation,
- a maintenance device of the mechanical resonator forming with this mechanical resonator a mechanical oscillator which defines the running speed of said mechanism,
- an electromechanical transducer arranged to be able to convert mechanical power from the mechanical oscillator into electrical power, when the mechanical resonator oscillates with an amplitude included in an effective functioning range, this electromagnetic transducer being formed by an electromagnetic assembly comprising at least one coil, mounted on an element from the mechanical assembly consisting of the mechanical resonator and the support thereof, and at least one magnet, mounted on the other element of this mechanical assembly, the electromagnetic assembly being arranged so as to be able to supply an induced voltage signal between the two output terminals of the electromechanical transducer when the mechanical resonator oscillates with an amplitude included in the effective functioning range, an electric converter connected to the two output terminals of the electromechanical transducer so as to be able to receive an induced electric current from this electromechanical transducer, this electric converter comprising a primary storage unit arranged to store electrical energy supplied by the electromechanical transducer, this electromechanical transducer and the electric converter forming a braking device of the mechanical resonator together, a device for regulating the frequency of the mechanical oscillator, this regulating device comprising an auxiliary oscillator and a measuring device arranged to be able to detect a potential time drift of the mechanical oscillator relative to the auxiliary oscillator, the regulating device being arranged to be able to determine whether the time drift measured corresponds to at least one certain gain.

The timepiece according to the invention is characterized in that:

the regulating device is arranged to be able also to determine whether the time drift measured corresponds to at least one certain loss, the braking device is arranged such that, in each oscillation period of the mechanical resonator when the oscillation amplitude thereof is in the effective functioning range, the induced voltage signal exhibits at least one first voltage lobe occurring at least mostly in a first half-alternation and suitable for generating in this first half-alternation a first induced current pulse to recharge the primary storage unit after an extraction of an electric load therefrom and at least one second voltage lobe occurring at least mostly in a second half-alternation and suitable for generating in this second half-alternation a second induced current pulse to recharge the primary storage unit after an extraction of an electrical load therefrom, the induced voltage signal thus exhibiting a plurality of such first voltage lobes and a plurality of such second voltage lobes, the regulating device comprises a load pump device arranged to be able to transfer on request a certain electric load from the primary storage unit into a secondary storage unit, the regulating device further comprises a logic control circuit which receives as an input a measurement signal supplied by the measuring device and which is arranged to be able to activate the load pump device so that, when the time drift measured corresponds to said at least one certain gain, it transfers a first electric load from the primary storage unit into the secondary storage unit such that recharging of the primary storage unit, following this transfer of the first electric load, is generated mostly by at least one first voltage lobe among said plurality of first voltage lobes, the logic control circuit being further arranged to be able to activate the load pump device so that, when the time drift measured corresponds to said at least one certain loss, it transfers a second electric load from the primary storage unit into the secondary storage unit such that recharging of the primary storage unit, following this transfer of the second electric load, is generated mostly by at least one second voltage lobe among said plurality of second voltage lobes.

The term 'voltage lobe' is understood to mean a voltage pulse which is situated entirely above or entirely below a null value (defining a zero voltage), i.e. a voltage variation within a certain time interval with either a positive voltage wherein the positive value rises then falls again, or a negative voltage wherein the negative value falls than rises again.

Transferring a first electric load in a first time zone as defined is envisaged to increase the recharging of the power supply capacitor upon the appearance of a first voltage lobe following this transfer, relative to the scenario where no transfer would take place. This increase in recharging means greater mechanical energy drawn from the mechanical oscillator by the braking system and therefore superior braking of this mechanical oscillator. As described hereinafter, braking in a first half-alternation before the passage of the mechanical resonator via the neutral position thereof induces a negative time-lag in the oscillation of the resonator, and thus the duration of the alternation in question is increased. Therefore, the instantaneous frequency of the mechanical oscillator is momentarily reduced and this results in a certain loss in the running of the mechanism which corrects at least partially the gain detected by the measuring device. Similarly, transferring a second electric load in a second time zone as defined is envisaged to increase the recharging of the power supply capacitor upon the appearance of a second voltage lobe following this extraction, relative to the scenario where no extraction would take place. As shall be understood hereinafter, this induces a positive time-lag in the oscillation of the resonator, and thus the duration of the alternation in question is reduced. Therefore, the instantaneous frequency of the mechanical oscillator is momentarily increased and this results in a certain gain in the running of the mechanism which corrects at least partially the loss detected by the measuring device.

In a main embodiment, the timepiece comprises a primary load connected or suitable for being regularly connected to the electric converter to be powered by the primary storage unit, the primary load comprising particularly the regulating device.

In one advantageous embodiment, the timepiece comprises an auxiliary load connected or suitable for being intermittently connected to the second storage unit so as to be able to be powered by this secondary storage unit.

In one preferred embodiment, the load pump device is arranged so as to form a voltage booster which is arranged so that an auxiliary power supply voltage at the terminals of the secondary storage unit is greater than a primary power supply voltage at the terminals of the primary storage unit.

In one particular embodiment, the regulating device comprises at least one dissipative circuit for dissipating the electrical energy stored in the primary storage unit, at least one switch associated with the dissipative circuit to be able to connect momentarily this dissipative circuit to the primary storage unit and a measurement circuit arranged to detect whether the voltage at the terminals of the second storage unit is greater than a first voltage limit or whether the filling level of the secondary storage unit is greater than a first filling limit. Then, the logic control circuit is arranged so as to be able, when the voltage at the terminals of the secondary storage unit is greater than the first voltage or filling limit, to connect momentarily said at least one dissipative circuit to the primary storage unit so as to carry out, when the time drift measured corresponds to said at least one certain gain, a first dissipative discharge of the primary storage unit such that recharging thereof, following this first discharge, is generated mostly by at least one first voltage lobe among said plurality of first voltage lobes, and so as to carry out, when the time drift measured corresponds to said at least one certain loss, a second discharge of the primary storage unit such that recharging thereof, following this second discharge, is generated mostly by at least one second voltage lobe among said plurality of second voltage lobes.

In one particular alternative embodiment of the advantageous embodiment mentioned above, the timepiece further comprises a measurement circuit arranged to detect whether the voltage at the terminals of the secondary storage unit is less than a second voltage limit (less than the first voltage limit mentioned above) or whether the filling level of the secondary storage unit is less than a second filling limit (less than the first filling limit mentioned above). Then, the logic control circuit is arranged so as to be able, when the voltage at the terminals of the secondary storage unit is less than the second voltage or filling limit and when the time drift measured is between said at least one certain loss and said at least one certain gain, to activate the load pump device so that it transfers a third electric load from the primary storage unit into the secondary storage unit, such that recharging of the primary storage unit following this transfer of a third electric load is generated mostly by at least one first voltage lobe among said plurality of first voltage lobes, and transfers a fourth electric load from the primary storage unit into the secondary storage unit, such that recharging the primary storage unit following this transfer of a fourth electric load is generated mostly by at least one second voltage lobe among said plurality of second voltage lobes, the fourth electric load being substantially equal to the third electric load.

BRIEF DESCRIPTION OF THE FIGURES

The invention will be described in more detail hereinafter using the appended drawings, given by way of examples that are in no way limiting, wherein.

DETAILED DESCRIPTION OF THE INVENTION

Figure 1:
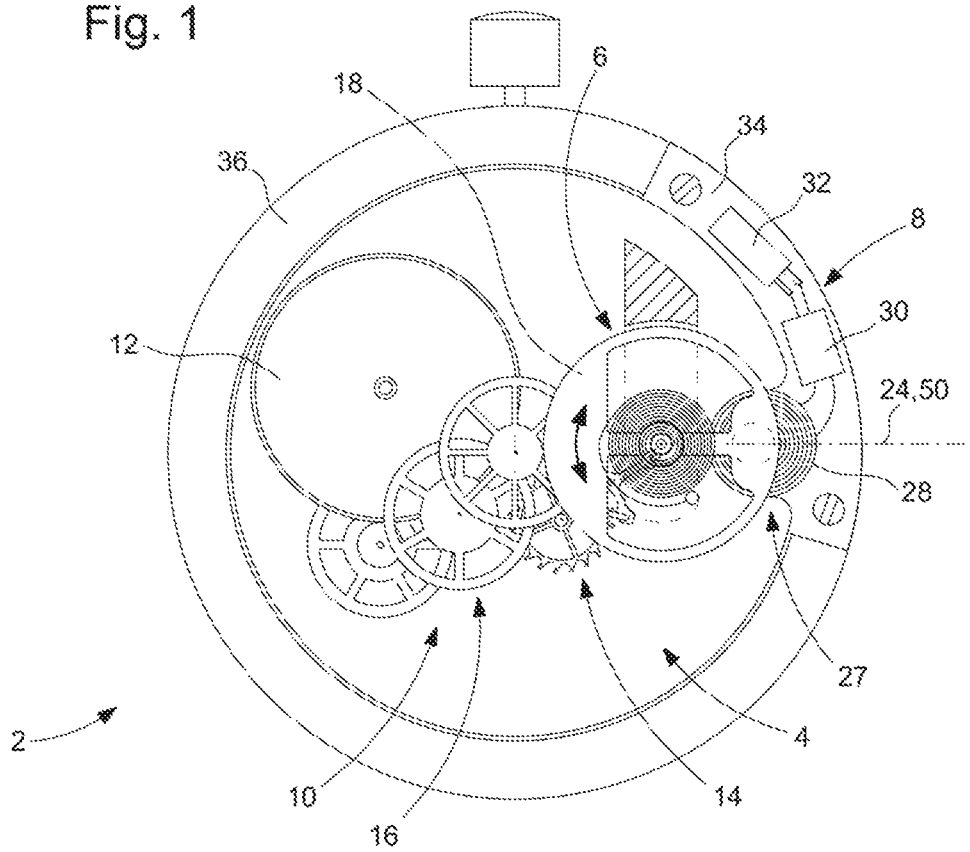
FIG. 1 is a general top view of a first embodiment of a timepiece according to the invention.
Figure 2:
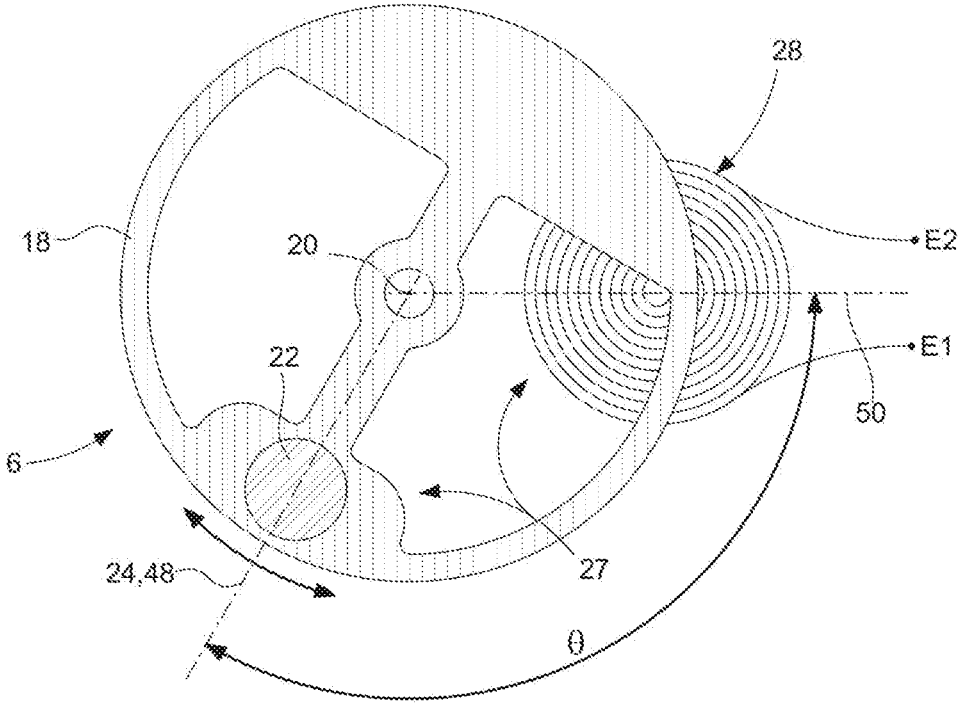
FIG. 2 is an enlarged partial view of the timepiece in FIG. 1, showing the electromagnetic assembly forming an electromagnetic transducer of a regulation system incorporated in this timepiece.

With reference to FIGS. 1 and 2, a timepiece according to the present invention will be described hereinafter. FIG. 1 is a partial plane view of a timepiece 2 comprising a mechanical movement 4, equipped with a mechanical resonator 6, and a regulation system 8. The maintenance means 10 of the mechanical resonator are conventional. They comprise a barrel 12 with a driving spring, an escapement 14 formed from an escapement wheel and a pallet assembly, as well as an intermediate geartrain 16 kinematically linking the barrel to the escapement wheel. The resonator 6 comprises a balance 18 and a standard balance-spring, the balance being pivotally mounted about an axis of rotation 20 between a plate and a bar. The mechanical resonator 6 and the maintenance means 10 (also referred to as excitation means) form a mechanical oscillator together. It shall be noted that, in general, in the definition of a mechanical timepiece oscillator, only the escapement is retained as maintenance means/excitation means of this mechanical oscillator, the energy source and an intermediate geartrain being considered separately. The balance-spring oscillates about the axis 20 when it receives mechanical pulses from the escapement wherein the escapement wheel is driven by the barrel. The geartrain 16 is part of a mechanism of the timepiece movement, the running speed whereof is set by the mechanical oscillator. This mechanism comprises, besides the geartrain 16, further wheels and analogue indicators (not shown) kinematically linked to this geartrain 16, the movement speed of these analogue indicators being set by the mechanical oscillator. Various mechanisms known to those skilled in the art may be envisaged.

FIG. 2 is a partial view of FIG. 1, along a horizontal cross-section at the level of the balance 18, showing a magnet 22 and a coil 28 forming an electromagnetic assembly 27 according to the invention. The coil 28 is preferably of the wafer type (disc shape having a relatively small thickness). It is arranged on the plate of the timepiece movement and conventionally comprises two connection ends E1 and E2. As a general rule, the electromagnetic assembly comprises at least one coil and a magnetized structure formed from at least one magnet generating a magnetic flux, in the direction of a general plane of the coil, which passes therethrough when the mechanical resonator oscillates with an amplitude included in an effective functioning range. In the example shown, the balance 18 bears, preferably in a zone situated in the vicinity of the outer diameter thereof defined by the felloe thereof, the bipolar magnet 22 which has an axially oriented magnetization axis. It shall be noted that it is preferable to confine the magnetic flux of the magnet or magnets borne by the balance using a casing formed by parts of the balance, in particular by magnetic parts arranged on both sides of the magnet along the axial direction such that the coil is partially situated between these two magnetic parts.

The balance 18 defines a half-axis 24, from the axis of rotation 20 thereof and perpendicularly thereto, which passes in the center of the magnet 22. When the balance-spring is in the rest position thereof, the half-axis 24 defines a neutral position (angular rest position of the balance-spring corresponding to a zero angle) about which the balance-spring may oscillate at a certain frequency, particularly at a free frequency FO corresponding to the natural oscillation frequency of the mechanical oscillator, i.e. not subject to external force torques (other than those supplied periodically via the escapement). In FIG. 2, the mechanical resonator 6 (represented in the balance-spring thereof which is situated above the cutting plane) is represented in the neutral position thereof, corresponding to the minimum potential mechanical energy state thereof. It is noted that, in the neutral position, the half-axis 24 defines a reference half-axis 48 which is out of step by an angle θ relative to the fixed half-axis 50 perpendicularly intercepting the axis of rotation 20 and the central axis of the coil 28. In other words, in projection in the general plane of the balance, the center of the coil 28 has an angular lag θ relative to the reference half-axis 48. In FIG. 2, this angular lag equals 120° in absolute values. Preferably, this angular lag θ is between 30° and 120° in absolute values.

Each oscillation of the mechanical resonator defines an oscillation period and it has a first alternation followed by a second alternation each between two extreme positions defining the oscillation amplitude of the mechanical resonator (note that the oscillating resonator and therefore the mechanical oscillator as a whole are considered herein, the oscillation amplitude of the balance-spring being defined inter alia by the maintenance means). Each alternation exhibits a passage of the mechanical resonator via the neutral position thereof at a median time and a certain duration between a start time and an end time which are defined respectively by the two extreme positions occupied by the mechanical resonator respectively at the start and at the end of this alternation. Each alternation thus consists of a first half-alternation ending at said median time and a second half-alternation starting at this median time.

The system 8 for regulating the frequency of the mechanical oscillator comprises an electronic circuit 30 and an auxiliary oscillator 32, this auxiliary oscillator comprising a clock circuit and for example a quartz resonator connected to this clock circuit. It shall be noted that, in one alternative embodiment, the auxiliary oscillator is integrated at least partially in the electronic circuit. The regulation system further comprises the electromagnetic assembly 27 described above, namely the coil 28 which is electrically connected to the electronic circuit 30 and the bipolar magnet 22 mounted on the balance. Advantageously, the various elements of the regulation system 8, with the exception of the magnet, are arranged on a support 34 with which they form an independent module of the timepiece movement. Thus, this module may be assembled or associated with the mechanical movement 4 during the mounting thereof in a case. In particular, as represented in FIG. 1, the above-mentioned module is attached to a casing ring 36 surrounding the timepiece movement. It is understood that the regulation module may therefore be associated with the timepiece movement once the latter is entirely assembled and adjusted, the assembly and disassembly of this module being possible without having to work on the mechanical movement per se.

With reference to FIGS. 3 to 6C, the physical phenomenon whereon the regulation principle implemented in the timepiece according to the invention is based will firstly be described. A timepiece similar to that in FIG. 1 is considered herein. The mechanical resonator 40, of which only the balance 42 has been represented in FIGS. 4A-4C and 6A-6C, bears a single bipolar magnet 44 the magnetization axis whereof is substantially parallel with the axis of rotation 20 of the balance, i.e. with an axial orientation. In this case, the half-axis in question 46 of the mechanical resonator 40 passes through the center of rotation 20 and the center of the magnet 44. In the example described, the angle θ between the reference half-axis 48 and the half-axis 50 has a value of approximately 90°. The two half-axes 48 and 50 are fixed relative to the timepiece movement, whereas the half-axis 46 oscillates with the balance and gives the angular position β of the magnet mounted on this balance relative to the reference half-axis, the latter defining the zero angular position for the mechanical resonator. More generally, the angular lag θ is such that an induced voltage signal generated in the coil on the passage of the magnet facing this coil is situated, upon a first alternation of any oscillation, prior to the passage of the median half-axis by the reference half-axis (therefore in a first half-alternation) and, during a second alternation of any oscillation, after the passage of this median half-axis via the reference half-axis (therefore in a second half-alternation).

Figure 3:
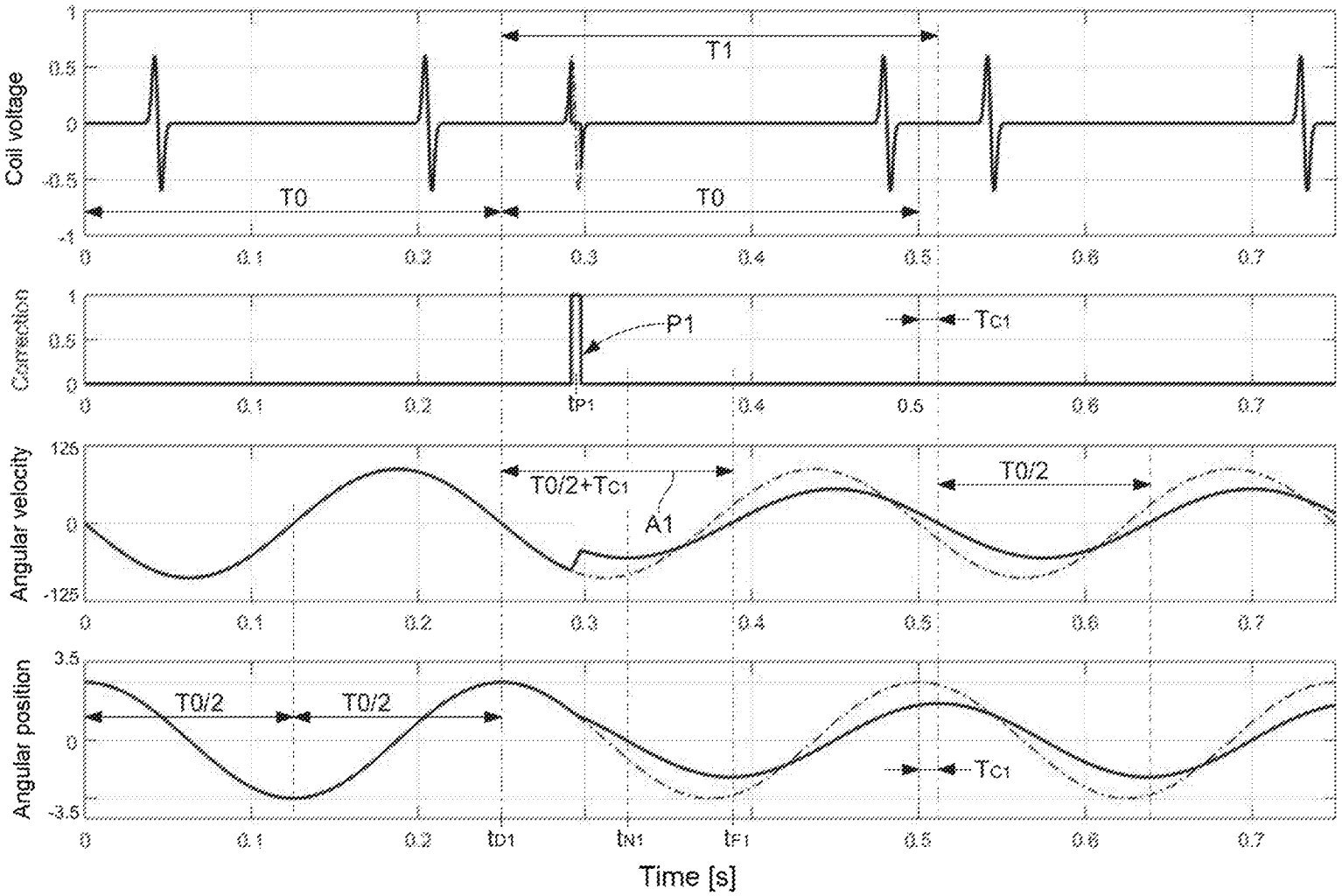
FIG. 3 represents, for an electromagnetic assembly given in FIGS. 4A to 4C which corresponds to the first embodiment, the induced voltage in the coil of this electromagnetic assembly when the balance-spring oscillates and the application of a first braking pulse in a certain alternation before the balance-spring passes via the neutral position thereof, as well as the angular velocity of the balance and the angular position thereof in a time interval wherein the first braking pulse occurs.

FIG. 3 shows four graphs. The first graph gives the voltage in the coil 28 over time when the resonator 40 oscillates, i.e. when the mechanical oscillator is activated. The second graph shows the time $t_{P1}$ at which a braking pulse is applied to the resonator 40 to make a correction in the running of the mechanism set by the mechanical oscillator. The time of the application of a rectangular-shaped pulse (i.e. a binary signal) is considered herein as the time position of the middle of this pulse. A variation in the oscillation period is observed during which the braking pulse and therefore an isolated variation of the frequency of the mechanical oscillator occur. In fact, as can be seen in the final two graphs of FIG. 3, respectively showing the angular velocity (values in radian per second: [rad/s]) and the angular position (values in radian: [rad]) of the balance over time, the time variation relates to the sole alternation during which the braking pulse occurs. It shall be noted that each oscillation has two successive alternations which are defined in the present text as the two half-periods during which the balance respectively sustains an oscillation movement in one direction and subsequently an oscillation movement in the other direction. In other words, as previously explained, an alternation corresponds to a swing of the balance in one direction or the other between the two extreme positions thereof defining the oscillation amplitude.

The term braking pulse denotes an application, substantially during a limited time interval, of a certain force couple to the mechanical resonator braking same, i.e. a force torque opposing the oscillation movement of this mechanical resonator. As a general rule, the braking torque may be of various types, particularly magnetic, electrostatic or mechanical. In the embodiment described, the braking torque is obtained by the magnet-coil coupling and therefore it corresponds to a magnetic braking torque applied on the magnet 44 via the coil 28 which is controlled by a regulating device. Such braking pulses may for example be generated by short-circuiting the coil momentarily. This action can be detected in the graph of the coil voltage in the time zone during which the braking pulse is applied, this time zone being envisaged upon the appearance of an induced voltage pulse in the coil by the passage of the magnet. It is obviously in this time zone that the magnet-coil coupling enables contactless action via a magnetic torque on the magnet attached to the balance. Indeed, it is observed that the coil voltage falls towards zero during a short-circuit braking pulse (the induced voltage in the coil 28 by the magnet 44 being shown with lines in the above-mentioned time zone). Note that the short-circuit braking pulses represented in FIGS. 3 and 5 are mentioned herein within the scope of the explanations given, as the present invention envisages recovery of the braking energy to power the regulating device in particular.

Figure 5:
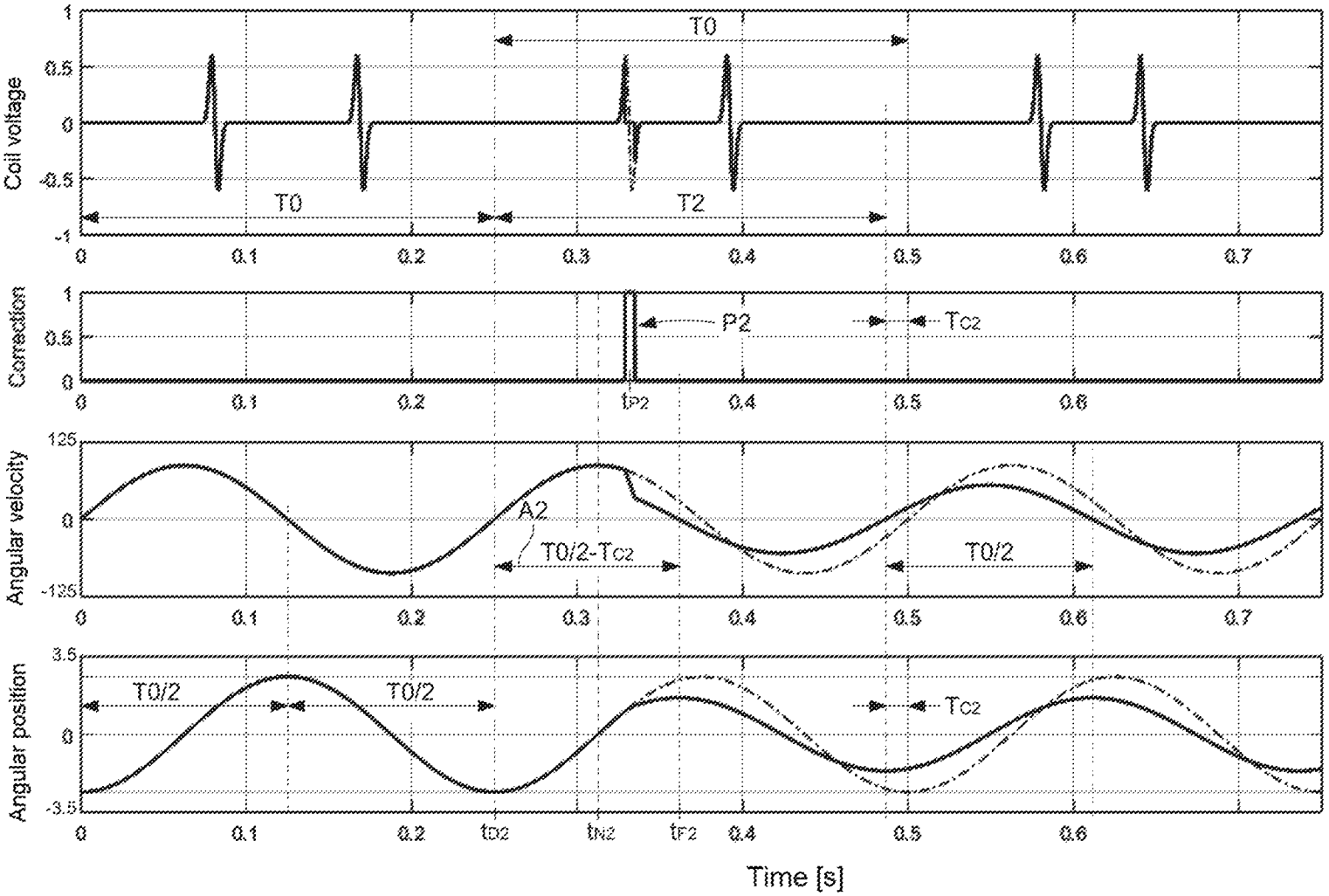
FIG. 5 is a figure similar to that in FIG. 3 with the application of a second braking pulse in a certain alternation after the balance-spring has passed via the neutral position thereof.

In FIGS. 3 and 5, the oscillation period T0 corresponds to a 'free' oscillation (i.e. without applying regulation pulses) of the mechanical oscillator. Each of the two alternations of an oscillation period has a duration T0/2 without external disturbance or constraint (particularly by a regulation pulse). The time t=0 marks the start of a first alternation. It shall be noted that the 'free' frequency F0 of the mechanical oscillator is herein approximately equal to four Hertz (F0=4 Hz), such that the period T0=250 ms approximately.

Figure 4A:
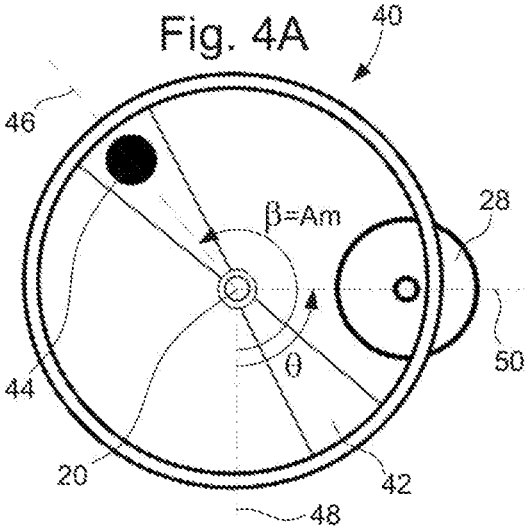
FIGS. 4A to 4C show, for the electromagnetic transducer in question in FIG. 3, the balance at three specific times of an alternation of the mechanical oscillator during which the first braking pulse is supplied.
Figure 4B:
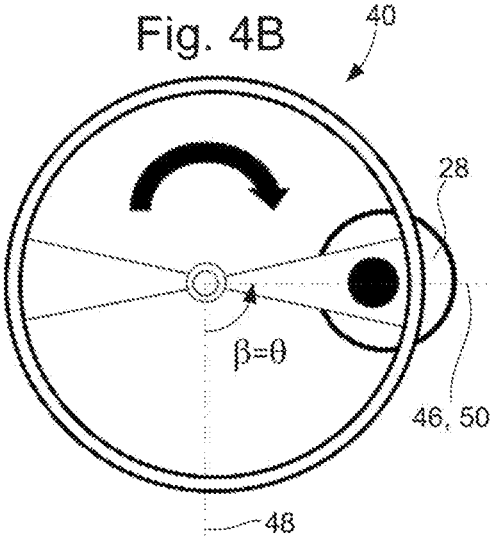
Figure 4C:
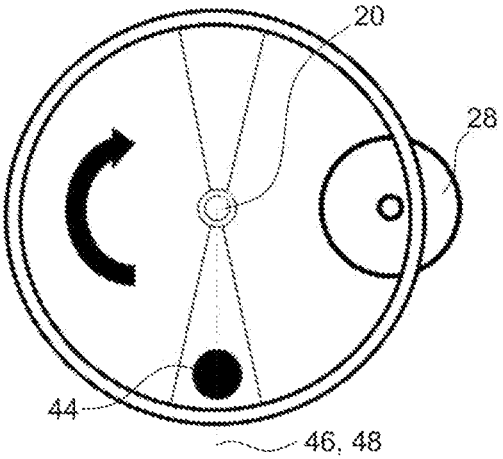

With reference to FIGS. 3 and 4A-4C, the behavior of the mechanical oscillator in a first scenario shall be described. After a first period T0 commences a new period T1, respectively a new alternation A1 during which a braking pulse P1 occurs. At the initial time $t_{D1}$ starts the alternation A1, the resonator 40 then being in the state in FIG. 4A where the magnet 44 occupies an angular position β corresponding to an extreme position (maximum positive angular position $A_m$). Then the braking pulse P1 occurs at the time $t_{P1}$ which is situated before the median time $t_{N1}$ at which the resonator passes via the neutral position thereof, FIGS. 4B, 4C representing the resonator at the two successive times $t_{P1}$ and $t_{N1}$ respectively. Finally, the alternation A1 ends at the end time $t_{F1}$.

In this first case, the braking pulse is generated between the start of an alternation and the passage of the resonator via the neutral position thereof, i.e. in a first half-alternation of this alternation. As envisaged, the angular velocity in absolute values decreases during the braking pulse P1. This induces a negative time-lag $T_{C1}$ in the oscillation the resonator, as shown by the two graphs of the angular velocity and of the angular position in FIG. 3, i.e. a loss relative to the non-disturbed theoretical signal (shown with broken lines). Thus, the duration of the alternation A1 is increased by a time interval $T_{C1}$. The oscillation period T1, comprising the alternation A1, is therefore extended relative to the value T0. This induces an isolated decrease in the frequency of the mechanical oscillator and a momentary slowing-down of the running of the associated mechanism.

Figure 6A:
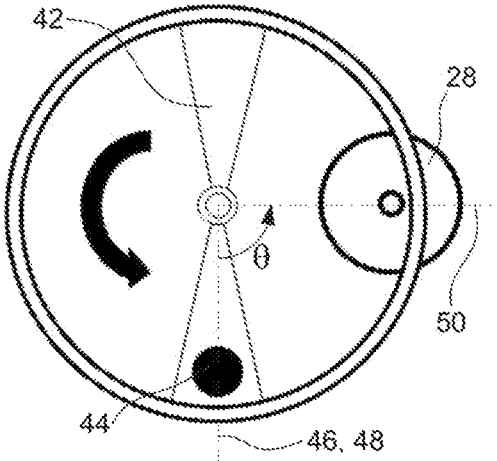
FIGS. 6A to 6C show the balance at three specific times of an alternation of the mechanical oscillator during which the second braking pulse is supplied.
Figure 6B:
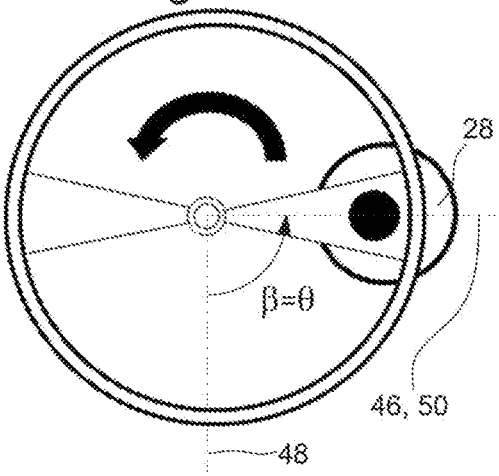
Figure 6C:
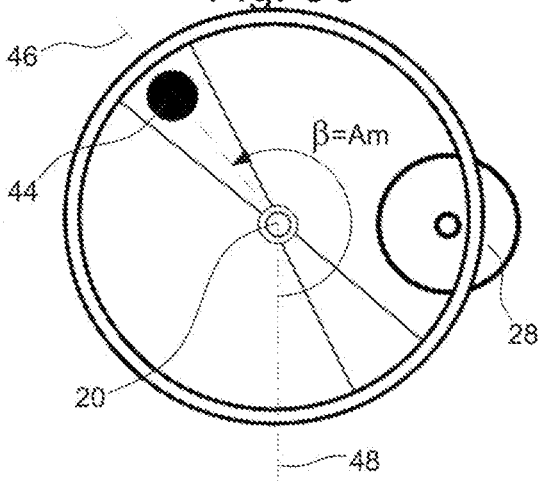

With reference to FIGS. 5 and 6A-6C, the performance of the mechanical oscillator in a second scenario shall be described. The graphs in FIG. 5 show the progression over time of the same variables as in FIG. 3. After a first period T0 commences a new period T2, respectively an alternation A2 during which a braking pulse P2 occurs. At the initial time $t_{D2}$ starts the alternation A2, the resonator 40 then being in an extreme position (maximum negative angular position not shown). After a quarter-period (T0/4) corresponding to a half-alternation, the resonator reaches the neutral position thereof at the median time $t_{N2}$ (configuration shown in FIG. 6A). Then the braking pulse P2 occurs at the time $t_{P2}$ which is situated after the median time $t_{N2}$ at which the resonator passes via the neutral position thereof in the alternation A2, i.e. in a second half-alternation of this alternation. Finally, this alternation ends at the end time $t_{F2}$ at which the resonator once again occupies an extreme position (maximum positive angular position). FIGS. 6B and 6C represent the resonator at the two successive times $t_{N2}$ and $t_{F2}$ respectively. It shall be noted in particular that the configuration in FIG. 6A is distinguished from the configuration in FIG. 4C by the reverse directions of the respective oscillation movements. Indeed, in FIG. 4C, the balance rotates in the clockwise direction when it passes via the neutral position in the alternation A1, whereas in FIG. 6A this balance rotates in the anti-clockwise direction upon passing via the neutral position in the alternation A2.

In the second scenario considered, the braking pulse is thus generated, in an alternation, between the median time at which the resonator passes via the neutral position thereof and the end time at which this alternation ends. As envisaged, the angular velocity in absolute values decreases during the braking pulse P2. Remarkably, the braking pulse induces herein a positive time-lag $T_{C2}$ in the oscillation period of the resonator, as shown by the two graphs of the angular velocity and of the angular position in FIG. 5, i.e. a gain relative to the non-disturbed theoretical signal (shown with broken lines). Thus, the duration of the alternation A2 is decreased by a time interval $T_{C2}$. The oscillation period T2, comprising the alternation A2, is therefore shorter than the value T0. Consequently, this induces an 'isolated' decrease in the frequency of the mechanical oscillator and a momentary acceleration of the running of the associated mechanism.

Figure 7:
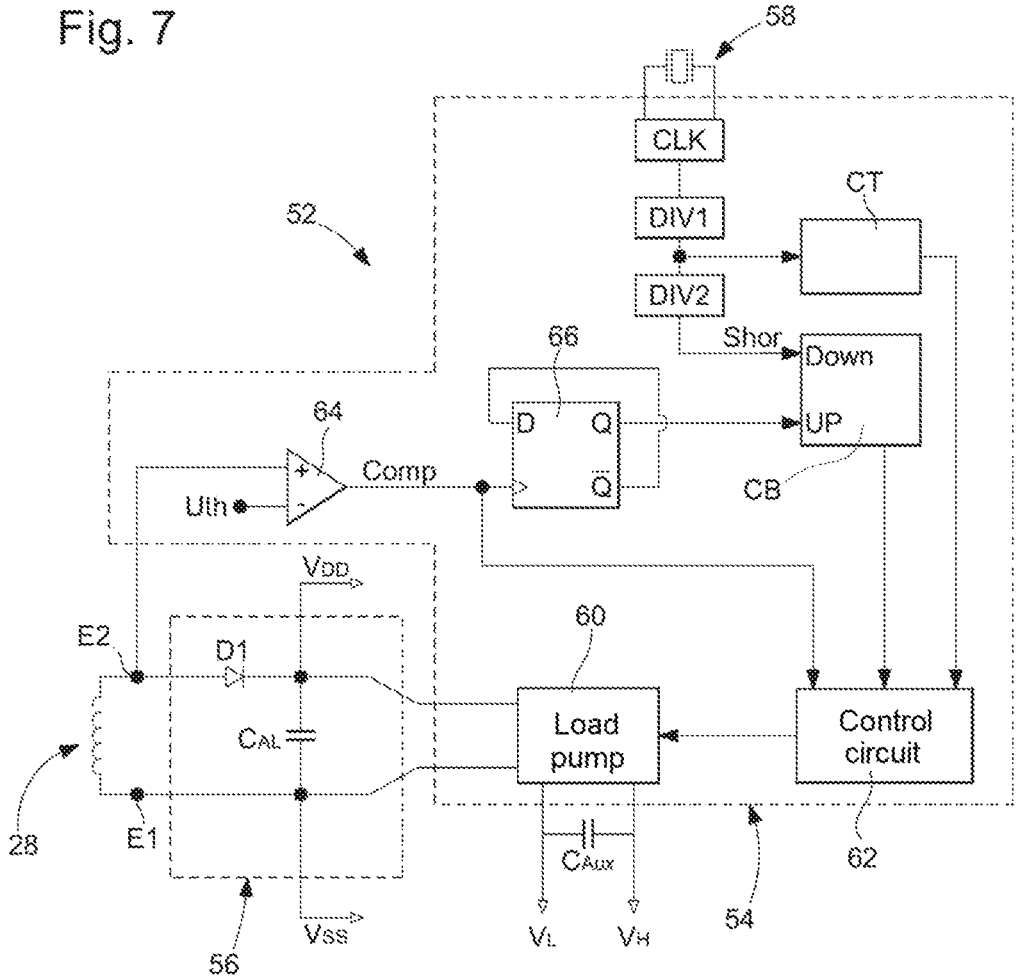
FIG. 7 shows the electrical diagram of an electric converter and a regulating device of the mechanical oscillator envisaged in the first embodiment of the timepiece.

With reference to FIGS. 1 and 2 described above and to FIGS. 7 to 10C, a first embodiment of a timepiece according to the invention shall be described hereinafter. This timepiece 2 comprises:

- a mechanism 12, 16 (shown partially),
- a mechanical resonator 6 (balance-spring) suitable for oscillating about a neutral position 48 corresponding to the minimal mechanical potential energy state thereof, each alternation of the successive oscillations having a passage of the mechanical resonator via the neutral position thereof at a median time and consisting of a first half-alternation ending at the median time thereof and of a second half-alternation starting at the median time thereof, a maintenance device 14 of the mechanical resonator forming with this mechanical resonator a mechanical oscillator which sets the running speed of the mechanism, an electromechanical transducer arranged to be able to convert mechanical power from the mechanical oscillator into electrical power, when the mechanical oscillator 6 oscillates with an amplitude included in an effective functioning range, this electromagnetic transducer being formed by an electromagnetic assembly 27 comprising a coil 28 (only element of the electromagnetic assembly represented schematically in FIG. 7), mounted on the support (in particular the plate of the movement 4) of the mechanical resonator, and a magnet 22 mounted on this mechanical resonator, the electromagnetic assembly 27 being arranged so as to be able to supply an induced voltage signal $U_i(t)$ (FIG. 10A) between the two output terminals E1 and E2 of the electromechanical transducer when the mechanical resonator oscillates with an amplitude included in the effective functioning range, an electric converter 56 connected to the two output terminals of the electromechanical transducer so as to be able to receive an induced electric current $I_{Rec}$ (FIG. 10B) from this electromechanical transducer, this electric converter comprising a power supply capacitor $C_{AL}$ arranged to be able to store the electrical energy supplied by the electromechanical transducer, this electromechanical transducer and the electric converter forming a braking device of the mechanical resonator together, a device 52 for regulating the frequency of the mechanical oscillator, this regulating device comprising an auxiliary oscillator 58 & CLK and a measuring device arranged to be able to measure a potential time drift of the mechanical oscillator relative to the auxiliary oscillator, the regulating device being arranged to be able to determine whether the time drift measured corresponds to at least one certain gain or to at least one certain loss.

Preferably, the electromagnetic assembly 27 also partly forms the measuring device. This measuring device further comprises a bidirectional counter CB and a comparator 64 (of the Schmidt trigger type). The comparator receives at one input the induced voltage signal $U_i(t)$ and at the other input a threshold voltage signal $U_{th}$ the value whereof is positive in the example given. As the induced voltage signal $U_i(t)$ has in each oscillation period of the resonator 6 two positive lobes (FIG. 10A) exceeding the value $U_{th}$, the comparator supplies as an output a signal 'Comp' having two pulses S1 and S2 (FIG. 10C) per oscillation period. This signal 'Comp' is supplied, on one hand, to a logic control circuit 62 and, on the other, to a control 66 which inhibits one pulse out of every two so as to supply a single pulse per oscillation period to a first input 'UP' of the bidirectional counter CB. The bidirectional counter comprises a second input 'Down' which receives a clock signal $S_{hor}$ at a nominal frequency/set-point frequency for the oscillation frequency, this clock signal being derived from the auxiliary oscillator which supplies a digital reference signal defining a reference frequency. The auxiliary oscillator comprises a clock circuit CLK serving to excite the quartz resonator 58 and supply in return the reference signal which is composed of a succession of pulses corresponding respectively to the oscillation periods of the quartz resonator.

The clock signal supplies the reference signal thereof to a divider DIV1 & DIV2 which divides the number of pulses in this reference signal by the ratio between the nominal period of the mechanical oscillator and the nominal reference period of the auxiliary oscillator. The divider thus supplies a clock signal $S_{hor}$ defining a set-point frequency (for example 4 Hz) and presenting one pulse per set-point period (for example 250 ms) to the counter CB. Thus, the state of the counter CB determines the gain (if the number is positive) or the loss (if the number is negative) accumulated over time by the mechanical oscillator relative to the auxiliary oscillator with a resolution corresponding substantially to a set-point period. The state of the counter is supplied to a logic control circuit 62 which is arranged to determine whether this state corresponds to at least one certain gain (CB>N1, where N1 is a natural number) or to at least one certain loss (CB<–N2, where N2 is a natural number).

The electric converter 56 comprises a circuit for storing electrical energy D1 & $C_{AL}$ which is arranged, in the alternative embodiment described, to be able to recharge the power supply capacitor $C_{AL}$ merely with a positive input voltage of the electric converter, i.e. merely with a positive induced voltage supplied by the coil 28. This power supply capacitor forms herein a primary storage unit in its own right. When recharging the power supply capacitor, the quantity of electrical energy supplied by the braking device to this power supply capacitor increases as the voltage level of this power supply capacitor lowers. A primary load is connected or suitable for being regularly connected to the electric converter 56 and powered by the power supply capacitor which supplies the primary power supply voltage $U_{AL}(t)$, represented in FIG. 10A, between the two power supply terminals $V_{DD}$ and $V_{SS}$, this primary load particularly comprising the regulation circuit 54.

Figure 8:
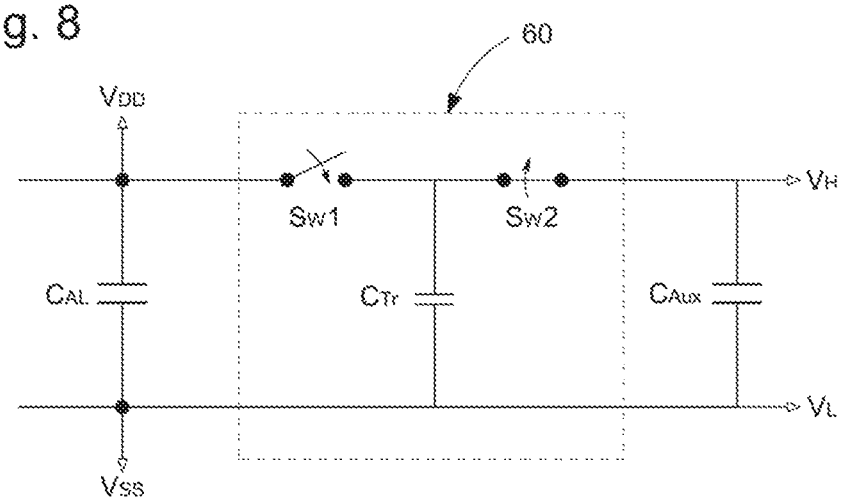
FIG. 8 shows the electronic circuit of an alternative embodiment of a load pump forming the regulating device represented in FIG. 7.

The timepiece 2 is remarkable in that the regulation circuit 54 of the regulating device comprises a load pump 60 arranged to be able to transfer on request a certain electric load from the power supply capacitor $C_{AL}$ into a secondary storage unit formed herein of a capacitor $C_{Aux}$. This capacitor $C_{Aux}$ is envisaged as a secondary power supply source for an auxiliary load, for example a light-emitting diode, an RFID circuit, a temperature sensor, or another electronic unit suitable for being incorporated in the timepiece according to the invention. To this end, the capacitor $C_{Aux}$ exhibits at the two terminals thereof respectively a lower potential $V_L$ and a higher potential $V_H$ defining an auxiliary power supply voltage. An alternative embodiment of such a load pump is represented in FIG. 8. It consists of a simple form of load pump which merely transfers charges without increasing the voltage such that in this case the auxiliary power supply voltage is envisaged less than the primary power supply voltage supplied by the electric converter 56. It shall be noted that this is a particular case which is not preferred. Further alternative load pump embodiments known to those skilled in the art may be envisaged, particularly those which have a voltage booster function. Such an alternative embodiment will be described hereinafter in the third embodiment. The load pump 60 comprises an input switch Sw1 and an output switch Sw2 with a transfer capacitor $C_{Tr}$. The switches Sw1 and Sw2 are controlled by the logic control circuit 62 according to a regulation method (FIG. 9) implemented in the first embodiment of the timepiece according to the invention which shall be described hereinafter.

Figure 10A:
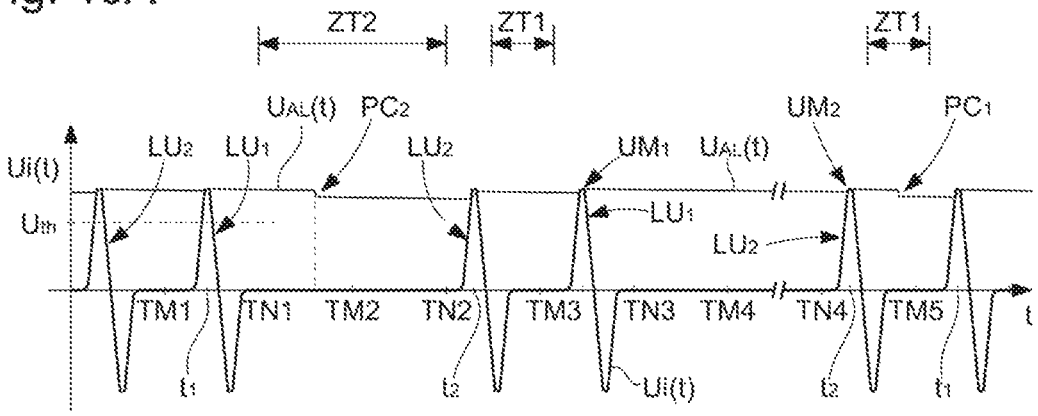
FIGS. 10A to 10C represent various electrical signals arising in the electrical diagram in FIG. 7.
Figure 10B:
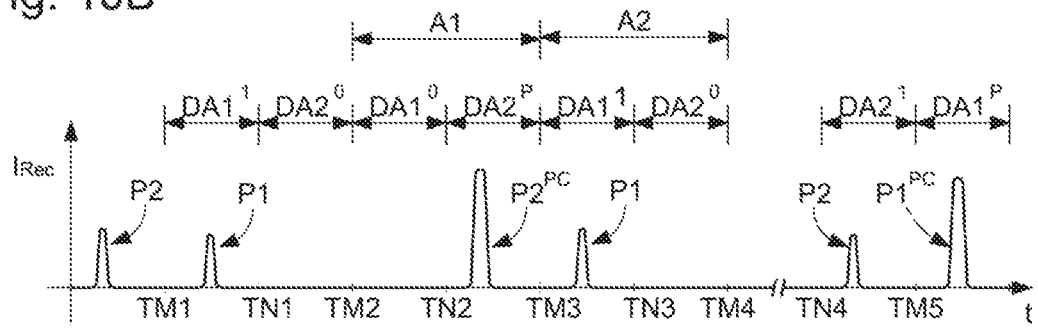

In FIGS. 10A and 10B, the induced voltage signal Ui(t) corresponds to that generated by the electromagnetic assembly 27 associated with the mechanical resonator 6 when the latter oscillates in an effective functioning range. On the time axis [t] are indicated the median times TNn, n=0, 1, 2, . . . , corresponding to the successive passages of the mechanical resonator via the neutral position thereof, as well as the times TMn, n=0, 1, 2, . . . , corresponding to the successive passages of the mechanical resonator alternately via the two extreme positions thereof where the angular velocity thereof is zero and the direction of the swing thereof is inverted. According to the invention, the braking device 27 & 56 is arranged such that, in each oscillation period of the mechanical resonator 6 at least when the oscillation amplitude of this mechanical resonator is in the effective functioning range, the induced voltage signal Ui(t) exhibits a first voltage lobe $LU_1$ occurring in a first half-alternation $DA1^1$, $DA1^P$ and a second voltage lobe $LU_2$ occurring in a second half-alternation $DA2^1$, $DA2^P$. The induced voltage signal thus exhibits alternately a succession of first voltage lobes $LU_1$ and second voltage lobes $LU_2$. Each first voltage lobe $LU_1$ exhibits a first maximum value $UM_1$ at a first time $t_1$ of the corresponding first half-alternation and each second voltage lobe $LU_2$ exhibits a second maximum value $UM_2$ at a second time $t_2$ of the corresponding second half-alternation.

Figure 10C:
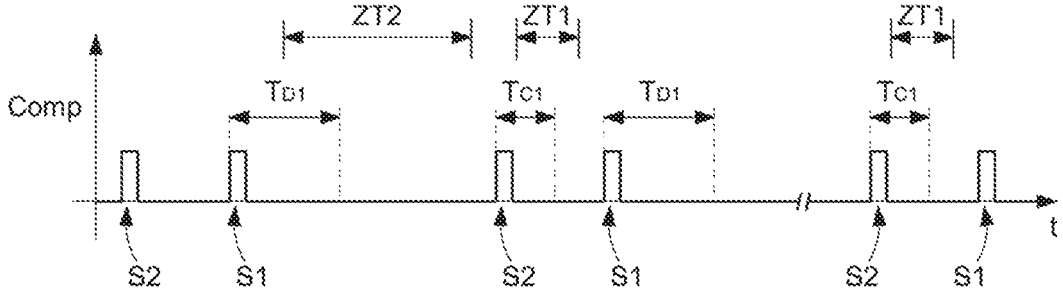

The first and second voltage lobes define, on one hand, first time zones ZT1 each situated before the first time $t_1$ of a different first voltage lobe and after the second time $t_2$ of the second voltage lobe preceding this first voltage lobe and, on the other, second time zones ZT2 each situated before the second time $t_2$ of a different second voltage lobe and after the first time $t_1$ of the first voltage lobe preceding this second voltage lobe. The first voltage lobes $LU_1$ generate pulses S1 in the signal 'Comp' at the output of the comparator 64, whereas the second voltage lobes $LU_2$ generate pulses S2 in this signal 'Comp' (FIG. 10C). In the alternative embodiment represented in FIG. 10A, the lobes considered for the generation of the signals S1 and S2 are the positive voltage lobes as a positive threshold voltage $U_{th}$ has been chosen. In an alternative embodiment which shall not be described in more detail hereinafter, it is possible to choose a negative threshold supplied at the input '+' of the comparator 64 (the induced voltage signal then being supplied at the input '−' thereof) and the negative voltage lobes generate the signals S1 and S2.

Then, the braking device is arranged such that, at least when no time drift is detected by the measuring device and at least when said primary load connected to the terminals $V_{SS}$ and $V_{DD}$ consumes continuously or quasi-continuously electrical energy stored in the power supply capacitor $C_{AL}$ (during a normal functioning phase of the timepiece, as represented in FIG. 10A where the power supply voltage $U_{AL}(t)$ has a certain negative slope in the absence of correction of the functioning of the mechanical oscillator), the first voltage lobes $LU_1$ and the second voltage lobes $LU_2$ generate alternately induced current pulses P1 and P2 (FIG. 10B) which recharge the power supply capacitor. It shall be noted that the electric converter 56 comprises a diode D1 arranged such that only the positive voltage lobes are suitable for recharging the capacitor $C_{AL}$. However, in an alternative embodiment which shall not be described in more detail hereinafter, the electric converter may have a diode arranged so as to define a single-alternation rectifier such that the negative voltage lobes are suitable for recharging the capacitor $C_{AL}$. In this case, it is thus the negative voltage lobes which generate induced current pulses and which are considered to determine the time zones for extraction of a certain electric load according to the time drift measured, as described hereinafter. It shall be noted that in a further alternative embodiment, the converter may comprise a double-alternation converter. In this case, upon each passage of the magnet 22 in front of the coil 28 a first pair of first consecutive voltage lobes or a second pair of two second consecutive voltage lobes all having substantially the same amplitude are obtained. Duplicates of the first of second voltage lobes described above are therefore obtained. This particular case must be considered with reference to the above disclosure taking the first and second pairs of voltage lobes instead of the first and second voltage lobes, and taking to determine the first and second time zones ZT1 and ZT2 the times $t_1$ and $t_2$ of the two adjacent lobes of two pairs following each other.

The load pump 60 is arranged to be able to extract on request a certain electric load from the power supply capacitor $C_{AL}$, and transfer same into the auxiliary capacitor $C_{Aux}$,so as to momentarily reduce the voltage level $U_{AL}(t)$ of this power supply capacitor $C_{AL}$. Once the power supply capacitor has been sufficiently charged to be able to power the regulation circuit 54, the logic control circuit 62 receives as an input a measurement signal supplied by the measuring device, namely from the bidirectional counter CB. This logic control circuit is arranged to activate the load pump 60 such that, when the time drift measured corresponds to at least one certain gain (CB>N1), it extracts a first electric load from the power supply capacitor $C_{AL}$ in a first time zone ZT1 and transfers this first load into the auxiliary load which forms a secondary power supply source. This results in a decrease in the voltage $U_{AL}(t)$. Similarly, the logic control circuit is arranged to activate the load pump 60 such that, when the time drift measured corresponds to at least one certain loss (CB<−N2), it extracts a second electric load from the power supply capacitor $C_{AL}$ in a second time zone ZT2, to lower the voltage $U_{AL}(t)$, and transfers this second electric load into the auxiliary capacitor.

Figure 9:
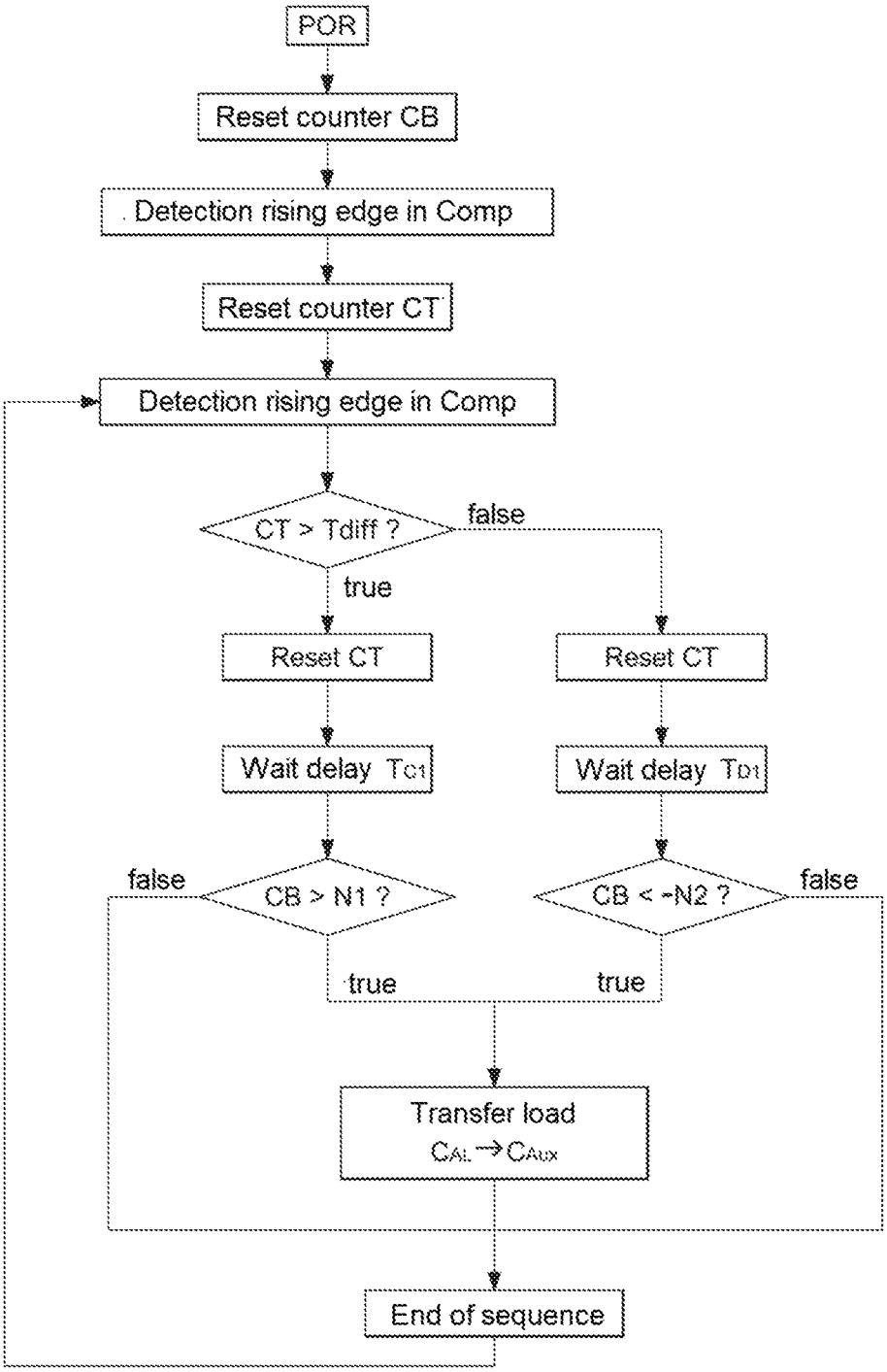
FIG. 9 is a flow chart of a method for regulating the running of the timepiece according to the first embodiment.

The regulation method implemented in the first embodiment of the invention is given in flow chart form in FIG. 9. After an initialization of the regulation circuit to 'POR', the counter CB is reset. Then, the detection of a rising edge of a pulse S1 or S2 supplied by the comparator 64 in the signal 'Comp' is awaited (see FIG. 10C) which it transmits to the logic control circuit 62, and the time counter CT is then initialized. Then, the detection of the rising edge in the signal 'Comp' (second rising edge of a pulse S2 or S1) is awaited.

On the detection of the second rising edge mentioned above in the signal 'Comp', the logic circuit 62 transfers the state/the value of the time counter CT into a register and compares this value to a differentiation value Tdiff which is selected less than a first time interval between a first pulse S1 and a second pulse S2 and greater than a second time interval between a second pulse S2 and a first pulse S1. Once the state of the time counter CT has been transferred into the register, this time counter is reset and a timer associated with the logic circuit 62 is engaged to measure a certain delay wherein the value $T_{C1}$ or $T_{D1}$ is selected according to the result of the comparison of the value of the counter CT with the value Tdiff. In the first embodiment, the regulating device therefore comprises a detection device, arranged to be able to detect the successive appearance alternately of first voltage lobes and second voltage lobes, and a time counter CT associated with the logic control circuit 62 to enable the latter to distinguish a first time interval, separating a first voltage lobe from a subsequent second voltage lobe, and a second time interval separating a second voltage lobe from a subsequent first voltage lobe, the first and second time intervals being different due to the arrangement of the electromagnetic assembly.

The arrangement of the electromagnetic assembly is envisaged herein such that the curve of the induced voltage signal Ui(t) exhibits two voltage lobes $LU_2$ and $LU_1$, with the same maximum amplitude ($UM_2$=$UM_1$), which occur in a second half-alternation and in the subsequent first half-alternation, but no voltage lobe of substantially the same amplitude is generated in the subsequent two half-alternations. The curve of the induced voltage signal Ui(t) represented in FIG. 10A results from the electromagnetic assembly 27 described above. In the first embodiment, the coil 28 exhibits at the center thereof an angular lag θ relative to the reference half-axis 48 (FIG. 2; angular position of the magnet 22 when the mechanical resonator 6 is in the rest position thereof) so as to generate in each oscillation period of the mechanical resonator, in said effective functioning range, merely two voltage lobes of the same polarity and substantially the same maximum amplitude which occur in two consecutive half-alternations and which form respectively one of said second voltage lobes and one of said first voltage lobes. Preferably, this angular lag θ is between 30° and 120° in absolute values.

During the above-mentioned comparison between the value of the time counter CT and the differentiation value Tdiff, the timer associated with the logic circuit waits either a delay $T_{C1}$ when the value of the time counter CT is greater than the differentiation value Tdiff, or a delay $T_{D1}$ when the value of the time counter CT is less than the differentiation value Tdiff. In the first case, the comparison makes it possible to ascertain whether the pulse detected is a pulse S2 generated by a second voltage lobe $LU_2$ and the delay $T_{C1}$ is chosen so that it ends in a first time zone ZT1 following this second voltage lobe. In the second case, the comparison makes it possible to ascertain whether the pulse detected is a pulse S1 generated by a first voltage lobe $LU_1$ and the delay $T_{D1}$ is chosen so that it ends in a second time zone ZT2 following this first voltage lobe. As a general rule, the regulating device comprises a timer associated with the logic control circuit to enable the latter to activate, if required, the load pump device after a first predetermined delay since the detection of a second voltage lobe, this first delay being selected such that it ends in a first time zone, or after a second predetermined delay since the detection of a first voltage lobe, this second delay being selected such that it ends in a second time zone.

In the first case mentioned above, when the delay $T_{C1}$ is attained, it is detected whether the counter CB, indicating a potential time drift of the mechanical oscillator, has a value greater than a given natural number N1 (positive number or equal to zero). If this is the case, the mechanical oscillator exhibits a gain relative to the auxiliary oscillator. To correct such a gain, it is envisaged according to the invention to transfer a first electric load from the power supply capacitor into the auxiliary capacitor at the end of the delay $T_{C1}$ mentioned above and therefore in the corresponding first time zone ZT1. The resulting decrease in the power supply voltage $U_{AL}(t)$ (indicated by the reference $PC_1$ in FIG. 10A) generates, upon the appearance of the first voltage lobe following the above-mentioned transfer, an induced current pulse $P1^{PC}$ having an amplitude greater than that of the pulse P1 which would occur in the absence of activation of the load pump. This increase in the induced current in the coil 28 means greater mechanical energy drawn from the mechanical oscillator by the braking device in a first half-alternation $DA1^P$. As described above, braking in a first half-alternation induces a negative time-lag in the oscillation of the mechanical resonator 6, and thus the duration of the half-alternation in question is increased. Due to the more intense braking performed in the first half-alternation $DA1^P$, the instantaneous frequency of the mechanical oscillator is momentarily reduced and this results in a certain loss in the running of the mechanism for which it sets the speed, which corrects at least partially the gain detected by the measuring device.

In the second case mentioned above, when the delay $T_{D1}$ is attained, it is detected whether the counter CB has a value less than a given negative number–N2, N2 being a natural number. If this is the case, the mechanical oscillator exhibits a loss relative to the auxiliary oscillator. To correct such a loss, it is envisaged according to the invention to transfer a second electric load from the power supply capacitor into the auxiliary capacitor at the end of the delay $T_{D1}$ mentioned above and therefore in the corresponding second time zone ZT2. The resulting decrease in the power supply voltage $U_{AL}(t)$ (indicated by the reference $PC_2$ in FIG. 10A) generates, upon the appearance of the second voltage lobe following the above-mentioned transfer, an induced current pulse $P2^{PC}$ having an amplitude greater than that of the pulse P2 which would occur in the absence of regulation. This increase in the induced current in the coil 28 means greater mechanical energy drawn from the mechanical oscillator by the braking device in a second half-alternation $DA2^P$. As described above, braking in a second half-alternation induces a positive time-lag in the oscillation of the mechanical resonator, and thus the duration of the half-alternation in question is reduced. Due to the more intense braking performed in the second half-alternation $DA2^P$, the instantaneous frequency of the mechanical oscillator is momentarily increased and this results in a certain gain in the running of the mechanism for which it sets the speed, which corrects at least partially the gain detected by the measuring device.

Extraction of an electric load in a first time zone ZT1 at the end of the delay $T_{C1}$, indicated by the reference $PC_1$ which indicates a descending step in the power supply voltage $U_{AL}(t)$, therefore generates an induced current pulse $P1^{PC}$ of greater amplitude in a first half-alternation $DA1^P$ of an alternation A2, this first half-alternation having a duration greater than those of the second half-alternations $DA1^0$ and $DA1^1$ which correspond respectively to a half-alternation during which no induced current pulse is generated and to a half-alternation during which a compensation pulse P1 of the electrical consumption of the primary load occurs. Extraction of an electric load in a second time zone ZT2 at the end of the delay $T_{D1}$ indicated by the reference $PC_2$ which indicates a descending step in the power supply voltage $U_{AL}(t)$, therefore generates an induced current pulse $P2^{PC}$ of greater amplitude in a second half-alternation $DA2^P$ of an alternation A1, this second half-alternation having a duration less than those of the second half-alternations $DA2^0$ and $DA2^1$ which correspond respectively to a half-alternation during which no induced current pulse is generated and to a half-alternation during which a compensation pulse P2 of the electrical consumption of the primary load occurs.

With the aid of FIGS. 11 to 15, a second embodiment of a timepiece according to the invention shall be described hereinafter.

Figure 11:
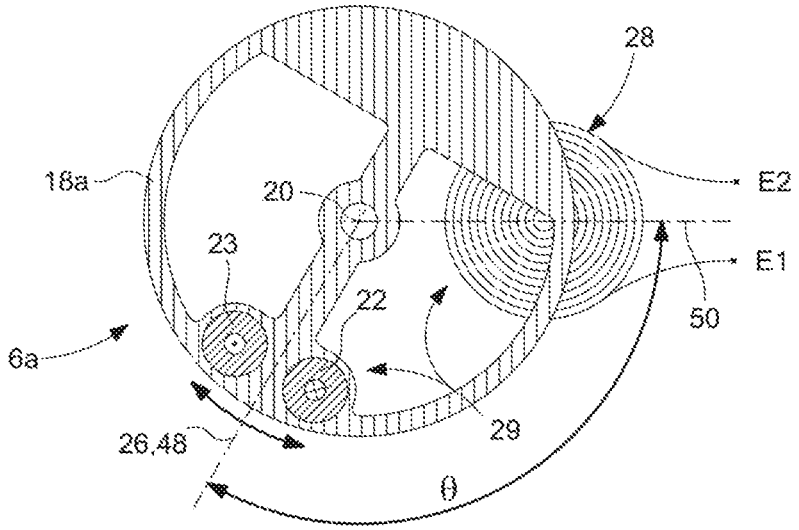
FIG. 11 is a partial view of a second embodiment of a timepiece according to the invention, showing the particular arrangement of the electromagnetic transducer thereof.

FIG. 11 is similar to FIG. 2, but for an electromagnetic assembly 29 forming the electromagnetic transducer of a timepiece according to the second embodiment. It shows the mechanical resonator 6*a* in a horizontal cross-section at the level of the balance 18*a* thereof, this mechanical resonator being incorporated in a timepiece movement, similar to that in FIG. 1, instead of the resonator 6 shown in this FIG. 1. The references previously described shall not be described again herein. As a general rule, there is envisaged an electromagnetic assembly which comprises at least the coil 28 and a magnetized structure formed from at least one magnet and having at least one pair of magnetic poles, of opposite polarities, each generating a magnetic flux in the direction of a general plane of the coil, this pair of magnetic poles being arranged such that, when the mechanical resonator 6*a* oscillates with an amplitude included in an effective functioning range, the respective magnetic fluxes thereof pass through the coil with a time-lag but with at least in part a simultaneity of the incoming magnetic flux and the outgoing magnetic flux, so as to form a central voltage lobe having a maximum peak value.

In the advantageous alternative embodiment in FIG. 11, the balance 18*a* bears a pair of bipolar magnets 22 and 23 having axially oriented magnetization axes with opposite polarities. This pair of magnets and the coil 28 form together the electromagnetic assembly 29 which is part of the regulation system. The magnets are arranged close to one another, at a distance enabling an addition of the respective interactions thereof with the coil 28 in respect of the induced voltage therein (more specifically for the generation of central voltage lobes). In one alternative embodiment not shown, a single bipolar magnet may be arranged with the magnetization axis thereof parallel with the plane of the balance and oriented tangentially to a geometric circle centered on the axis of rotation 20. The induced voltage signal in the coil may have substantially the same profile as for the pair of magnets described above, but with a lesser amplitude given that only a portion of the magnetic flux of the magnet passes through the coil. Magnetic flux conducting elements may be associated with the single magnet to direct the magnetic flux thereof substantially in the direction of the general plane of the coil.

The balance 18*a* defines a half-axis 26, from the axis of rotation 20 thereof and perpendicularly thereto, which passes in the middle of the pair of magnets. When the balance-spring is in the rest position thereof, the half-axis 26 defines a neutral position about which the balance-spring may oscillate. The mechanical resonator 6*a* is represented in the neutral position thereof in FIG. 11 and the half-axis 26 thereof defines a reference half-axis 48 which is out of step by an angle θ relative to the fixed half-axis 50 intercepting the axis of rotation 20 and the central axis of the coil 28. Preferably, this angular lag θ is between 30° and 120° in absolute values.

Figure 14:
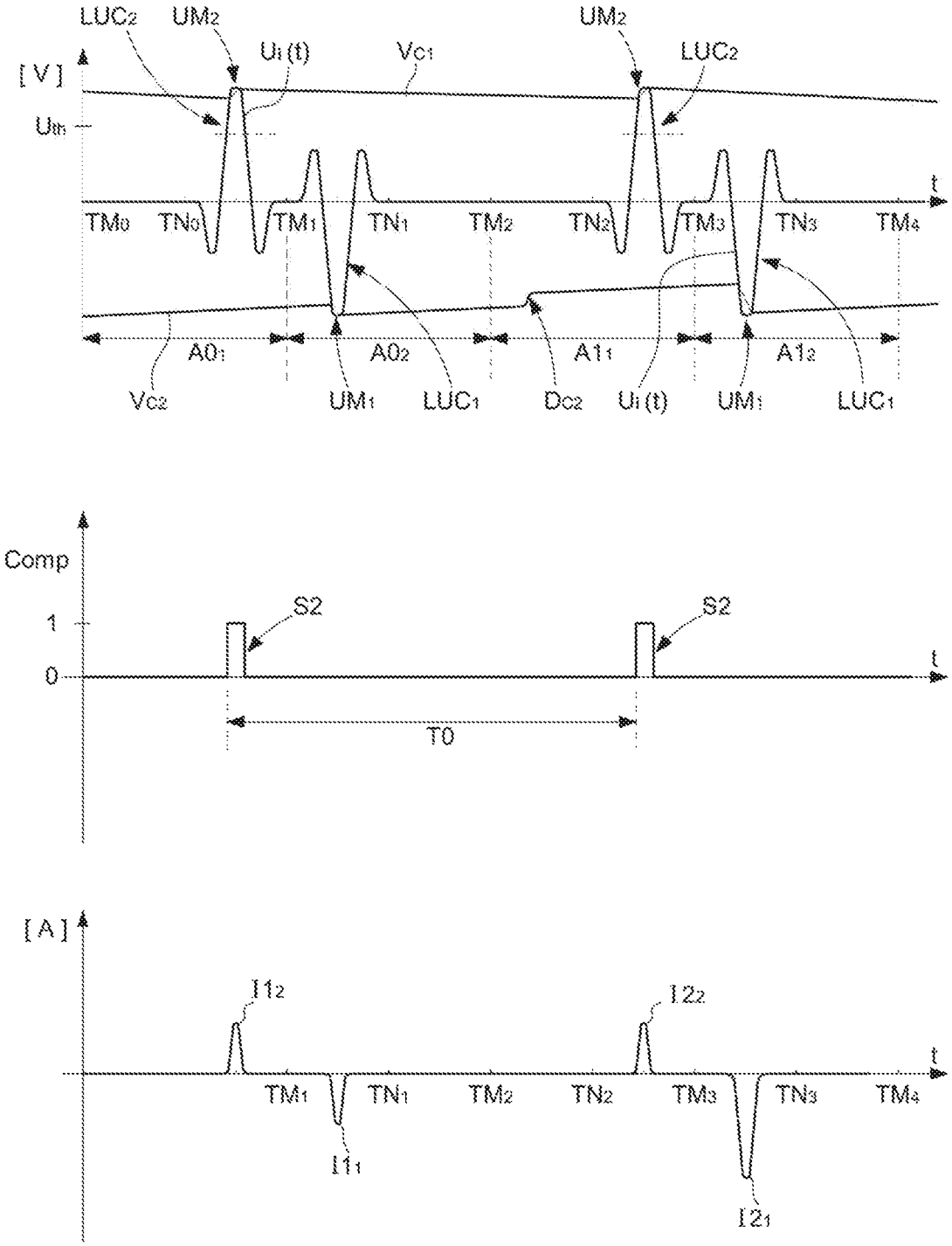
FIG. 14 represents various electrical signals arising in the electrical diagram in FIG. 12 in the case of correction of a gain observed in the time drift measured.
Figure 15:
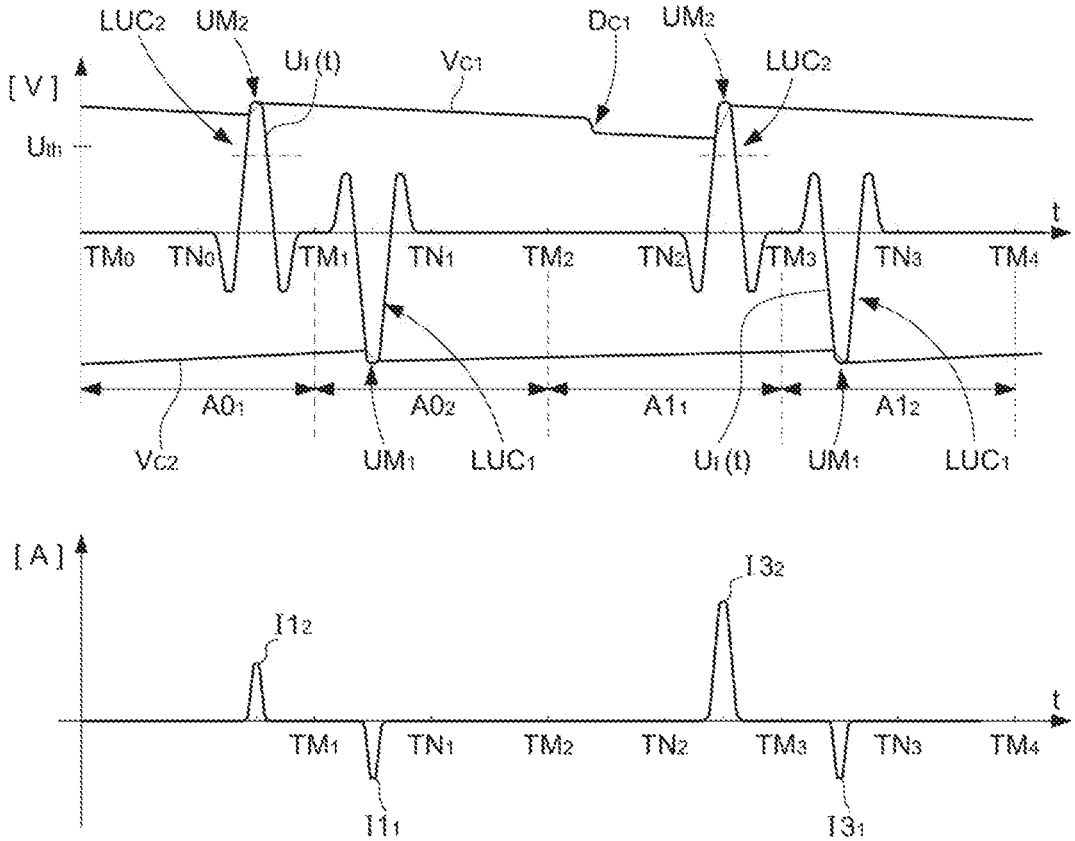
FIG. 15 represents various electrical signals arising in the electrical diagram in FIG. 12 in the case of correction of a loss observed in the time drift measured.

In the alternative embodiment represented in FIGS. 14 and 15, the induced voltage signal Ui(t) generated by the electromechanical assembly 29 exhibits, in each oscillation period of the mechanical oscillator, a first central voltage lobe $LUC_1$ (as referred to as first voltage lobe) having a maximum negative voltage $UM_1$ and a second voltage lobe $LUC_2$ (also referred to as second voltage lobe) having a maximum positive voltage $UM_2$. By means of the angular lag θ of the coil relative to the reference half-axis 48, a second voltage lobe and a first voltage lobe occur respectively in a second half-alternation of an alternation $A0_1, A1_1, \ldots, AN_1$, where N is a natural number, and in a first half-alternation of the next alternation $A0_2, A1_2, \ldots, AN_2$, where N is a natural number, of each oscillation period. In a further alternative embodiment, the polarities of the voltage lobes are opposite, i.e. the first voltage lobes have a positive voltage whereas the second voltage lobes have a negative voltage. It shall be noted that merely inverting the terminals E1 and E2 of the coil 28 or, equivalently, the winding direction of the wire forming this coil induces a change of polarity for the induced voltage such that such an inversion makes it possible to switch from one alternative embodiment to the other.

Preferably, the electromagnetic assembly 29 also partly forms the measuring device, as in the first embodiment. The part of the electrical diagram in FIG. 12 relative to the device for measuring a potential time drift of the mechanical oscillator shall not be described again in detail. It shall be noted that the comparator 64 delivers a signal 'Comp', represented in FIG. 14, which exhibits a pulse S2 per oscillation period. Thus this signal may be directly supplied to the bidirectional counter CB.

Figure 12:
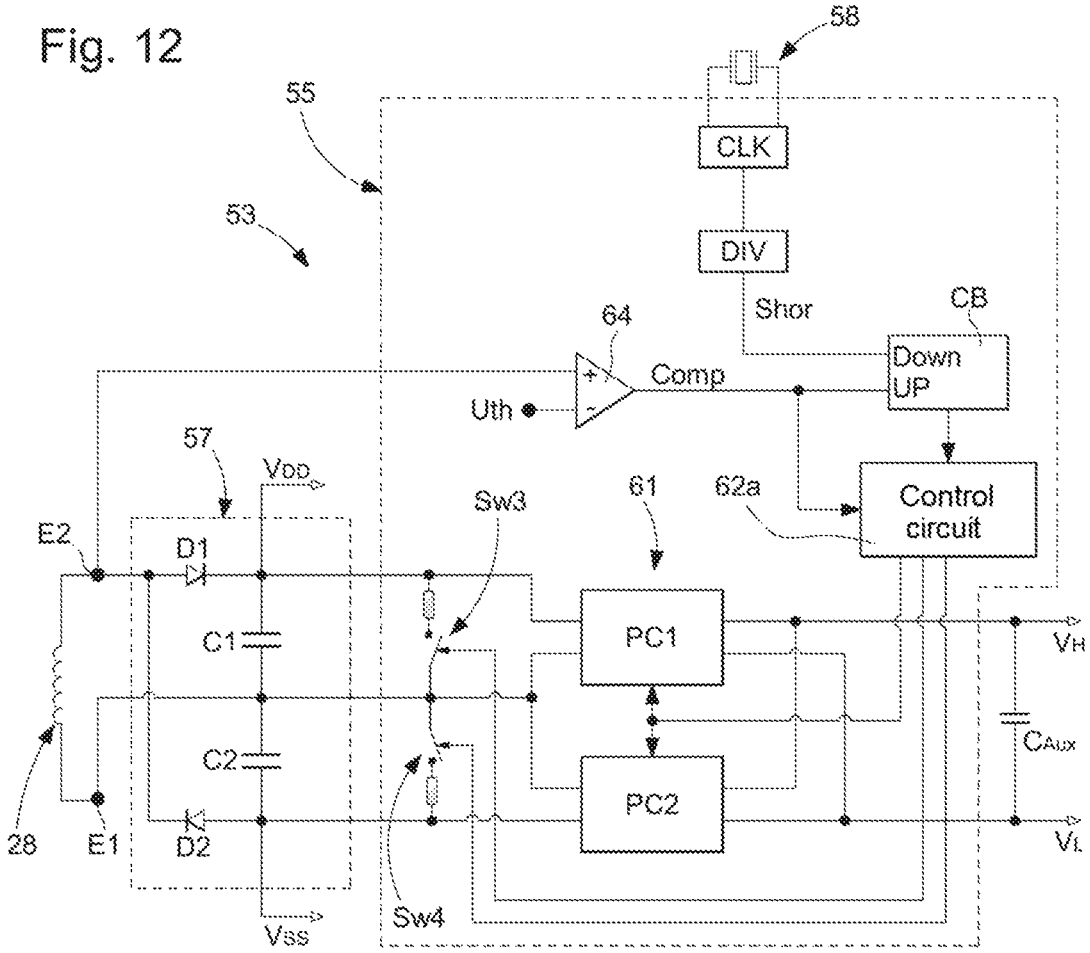
FIG. 12 shows the electrical diagram of the electric converter and the regulating device of the mechanical oscillator as arranged in the second embodiment of a timepiece according to the invention.

In FIG. 12, the electric converter 57 comprises a first circuit D1 & C1 for storing electrical energy which is arranged to be able to recharge a first power supply capacitor C1 of the primary storage unit merely with a positive input voltage of the electric converter and a second circuit D2 & C2 for storing electrical energy which is arranged to be able to recharge a second power supply capacitor C2 of the primary storage unit merely with a negative input voltage of the electric converter. During recharging, the quantity of electrical energy supplied selectively by the braking device to the first power supply capacitor and to the second power supply capacitor increases as the voltage level in absolute values of this first power supply capacitor, respectively of this second power supply capacitor lowers.

A primary load is connected or suitable for being regularly connected at the output of the electric converter 57 and powered by the primary power supply unit which supplies the power supply voltages $V_{DD}$ and $V_{SS}$. This primary load particularly comprises the regulation circuit 55. Preferably, the first and second power supply capacitors have substantially the same capacity value.

The regulation circuit 55 of the regulating device 53 comprises a load pump device 61 formed by two load pumps PC1 and PC2, advantageously identical, which are arranged to transfer on request electric loads respectively from the first power supply capacitor C1 and from the second power supply capacitor C2 into the auxiliary capacitor $C_{Aux}$. As in the first embodiment, this auxiliary capacitor forms a secondary storage unit which supplies an auxiliary power supply voltage between the two terminal $V_L$ and $V_H$ thereof. The two load pumps PC1 and PC2 are controlled by the logic control circuit 62*a*. An alternative embodiment of a load pump suitable for each forming two load pumps has previously been described with reference to FIG. 8. In a main alternative embodiment, the two load pumps are replaced by a single load pump which then comprises switches controlled by the control circuit 62*a* so as to be able to transfer electric loads into the auxiliary capacitor by drawing selectively these electric loads in the first capacitor C1 and in the second capacitor C2 according to the correction sought, as shall be described hereinafter in the description of the regulation method implemented in the control circuit 62*a* within the scope of the second embodiment. In the alternative embodiment described, the regulation circuit 55 further comprises two dissipative circuits each formed from a resistor and a switch Sw3, respectively Sw4. These two dissipative circuits comprise a certain resistance and are respectively arranged in parallel with the two capacitors C1 and C2, between the latter and the two load pumps PC1 and PC2.

In FIGS. 14 and 15 are also represented the positive voltage $V_{C1}$ at the upper terminal (defining $V_{DD}$) of the power supply capacitor C1 and the negative voltage $V_{C2}$ at the lower terminal (defining $V_{SS}$) of the power supply capacitor C2 (the zero voltage being that of the end E1 of the coil connected between the two capacitors arranged in series). The power supply voltage $V_{AL}$ available is therefore given by $V_{C1}$-$V_{C2}$, i.e. the sum of the respective voltages of the first and second capacitors C1 and C2. In the preferred alternative embodiment described herein, a primary load is arranged at the output of the electric converter. It particularly comprises the regulation circuit 55 which is powered by the first and second power supply capacitors arranged in series and delivering the power supply voltage $V_{AL}$. The voltage lobes $LUC_1$ and $LUC_2$ which exhibit respectively the maximum negative induced voltage $UM_1$ (in absolute values) and the maximum positive induced voltage $UM_2$ serve to recharge the capacitors C2 and C1, respectively. Thus, outside brief recharging periods of one and the other of the power supply capacitors, there is a certain progressive decrease (in absolute values) of the voltages $V_{C1}$ and $V_{C2}$ over time.

In the first oscillation period T0 during which no regulation event occurs, an induced current peak $I1_2$ recharges the capacitor C1 in a second half-vibration and an induced current pulse $I1_1$ recharges the capacitor C2 in a first half-vibration. These induced current pulses correspond to electrical powers induced by the electromechanical transducer in the electromagnetic assembly 29 and absorbed by the electric converter 57. These electrical powers thus correspond to mechanical powers supplied by the mechanical oscillator. They are converted by the electric converter and consumed by the primary load associated therewith. Thus each induced current pulse $IN_1$ and $IN_2$, N=1, 2, . . . , supplied by the electromechanical transducer to the electric converter corresponds to a braking pulse and thus to a certain momentary braking torque applied to the mechanical oscillator. According to the physical phenomenon disclosed above with reference to FIGS. 3 to 6, the induced current pulses $IN_2$, each occurring in a second half-vibration, induce a decrease in the duration of the vibrations during which they occur, and therefore an increase in the instantaneous frequency of the mechanical oscillator, whereas the induced current pulses IN1, each occurring in a first half-vibration, induce an increase in the duration of the vibrations during which they occur, and therefore a decrease in the instantaneous frequency of the mechanical oscillator.

In a period of functioning during which no regulation event and no particular performance resulting from such a regulation event occurs, i.e. in a period corresponding to normal functioning without regulation, therefore the scenario represented in the first oscillation period in FIGS. 14 and 15 arises in respect of the voltages $V_{C1}$ and $V_{C2}$ and the recharging pulses of the capacitors C1 and C2 generated respectively by the induced current pulses $I1_2$ and $I1_1$, i.e. a poised scenario wherein a first electrical energy absorbed by the electric converter generally in the two first half-vibrations of each oscillation period is substantially identical to a second electrical energy absorbed by the electric converter generally in the two second half-vibrations of this oscillation period. Thus, the positive time-lag which occurs generally in the two second half-vibrations is compensated by the negative time-lag which occurs generally in the two first half-vibrations of each oscillation period. In the particular case represented in FIGS. 14 and 15, the positive time-lag which occurs in the first vibration $A0_1$ is compensated by the negative time-lag which occurs in the second vibration $A0_2$ of the corresponding oscillation period. It is understood therefore that, although the duration of the first vibration is different from that of the second vibration, the sum thereof is equal to a natural oscillation period T0 of the mechanical oscillator not subject to a regulation action.

Figure 13:
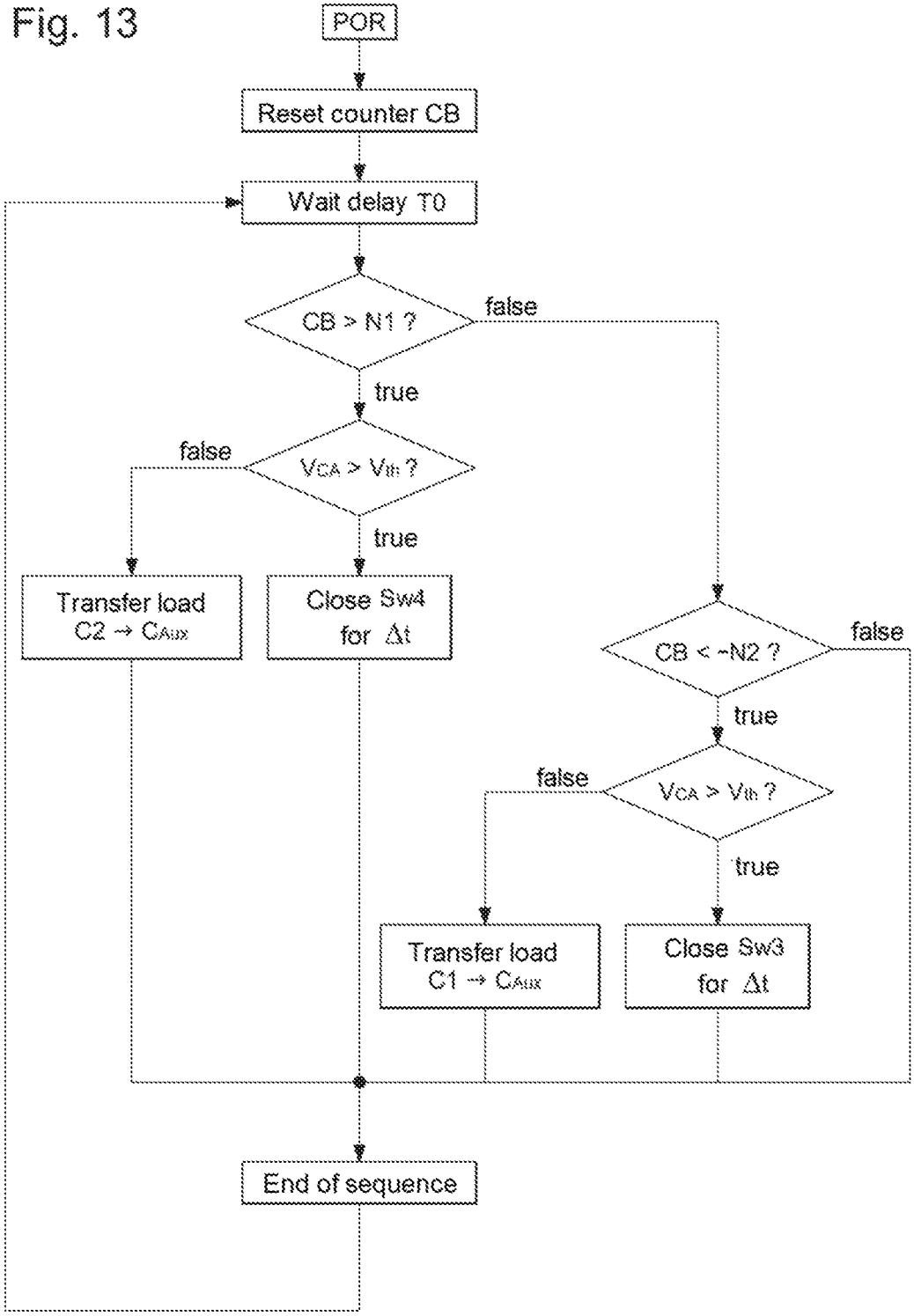
FIG. 13 is a flow chart of a method for regulating the running of the timepiece according to the second embodiment.

The regulation method implemented in the logic control circuit 62*a* of the load pump device 61 is given by the flow chart in FIG. 13. After having initialized the regulation circuit to 'POR' and in particular the bidirectional counter CB, a certain delay, i.e. a certain time interval, for example a period T0 or a plurality of periods T0 is waited, and the control circuit 62*a* determines whether at least one certain gain (CB>N1) has occurred in the running of the timepiece. If so, in the present alternative embodiment, the regulation circuit is arranged such that the control circuit can detect whether the voltage $V_{CA}$ at the terminals of the auxiliary capacitor is greater than a voltage threshold $V_{th}$, which corresponds to a certain voltage for which the auxiliary capacitor is filled to a level such that the load pumps can no longer transfer significant electric loads from either of the capacitors C1 and C2 into the auxiliary capacitor. In this case, to make a correction of the gain detected, the switch Sw4 is closed during a short time interval Δt to induce a certain discharge of the capacitor C2 via the corresponding dissipative circuit, indicated by the step $D_{C2}$ (which is descending in absolute values as the voltage of the capacitor C2 decreases) in the voltage $V_{C2}$ in FIG. 14.

If the voltage $V_{CA}$ is equal to or less than the voltage threshold $V_{th}$, then the control circuit activates the load pump PC2 so that it transfers a first electric load from the second power supply capacitor C2 into the auxiliary capacitor $C_{Aux}$. This regulation action also results in a decrease in the voltage $V_{C2}$ indicated by the descending step $D_{C2}$. This decrease in the voltage $V_{C2}$ induces, at least in an oscillation period following such a transfer, an increase in the recharging of the second capacitor C2 relative to the hypothetical case where such a transfer of the first electric load would not take place. The decrease of the voltage $V_{C2}$ performed by the control circuit in the alternation $A1_1$ induces upon the appearance of the next voltage lobe $LUC_1$ in the next alternation $A1_2$ an induced current pulse $I2_1$ wherein the amplitude (voltage peak value) is greater than that of the preceding one $I1_1$. Given that this induced current pulse $I2_1$ occurs in a first half-alternation, as all the induced current pulses recharging the capacitor C2, a decrease in the voltage of this capacitor C2 always generates at least one regulation pulse which generates a negative time-lag in the oscillation of the mechanical oscillator and therefore which reduces momentarily the oscillation frequency to correct at least partially the gain detected in the running of the timepiece (positive time drift). It shall be noted that the pulses $I1_2$ and $I2_2$ have an amplitude, in absolute values, substantially equal to that of the pulse $I1_1$, these pulses each corresponding to an induced current pulse generated by the sole consumption of the primary load. Therefore, these consist of standard/nominal recharging pulses.

If no gain is detected in the running of the timepiece, then the control circuit determines whether at least one certain loss (CB<−N2) has occurred in the running of this timepiece. If so, the regulation circuit detects whether the voltage $V_{CA}$ at the terminals of the auxiliary capacitor is greater than the voltage threshold $V_{th}$. In this case, to make a correction of the loss detected, the switch Sw3 is closed during a short time interval Δt to induce a certain discharge of the capacitor C2 via the corresponding dissipative circuit, indicated by the step $D_{C1}$ (which is descending in absolute values as the voltage of the capacitor C2 decreases) in the voltage $V_{C2}$ in FIG. 15. If the voltage $V_{CA}$ is equal to or less than the voltage threshold $V_{th}$, then the control circuit activates the load pump PC1 so that it transfers a second electric load from the first power supply capacitor C1 into the auxiliary capacitor $C_{Aux}$. This regulation action also results in a decrease in the voltage $V_{C1}$ indicated by the step $D_{C1}$. This decrease in the voltage $V_{C1}$ induces, at least in an oscillation period following such a transfer, an increase in the recharging of the second capacitor C1 relative to the hypothetical case where such a transfer of the second electric load would not take place. The decrease of the voltage $V_{C1}$ performed by the control circuit in the vibration $A1_1$ induces upon the appearance of the next voltage lobe $LUC_2$ in the same vibration an induced current pulse $I3_2$ wherein the amplitude is greater than that of the preceding one $I1_2$. Given that this induced current pulse $I3_2$ occurs in a second half-vibration, as all the induced current pulses recharging the capacitor C1, a decrease in the voltage of this capacitor C1 always generates at least one regulation pulse which generates a positive time-lag in the oscillation of the mechanical oscillator and therefore which increases momentarily the oscillation frequency to correct at least partially the loss detected in the running of the timepiece (negative time drift). The next pulse $I3_1$ exhibits once again substantially a standard/nominal amplitude.

The second embodiment has a significant advantage in that the selective extraction of an electric load in the capacitor C1 or C2 according to a time drift detected in the running of the timepiece may occur at any time since the first voltage lobes, which occur merely in first half-alternations, have the same first polarity whereas the second voltage lobes, which occur merely in second half-alternations, have the same second polarity opposite the first polarity and in that the capacitors C1 and C2 can only be recharged respectively by induced voltages of opposite polarities. Therefore, it is simply necessary for the logic control circuit to determine which polarity, first or second, is suitable for recharging which capacitor, C1 or C2, to carry out selectively an extraction of a certain electric load in one or the other of these two capacitors according to the type of a time drift detected, gain or loss, by a transfer of a certain electric load in the auxiliary capacitor or by the dissipation thereof via one of the two dissipative circuits envisaged if the auxiliary capacitor is full. In one alternative embodiment, a timer is however envisaged which determines a certain delay following the appearance of a pulse S2 in the signal 'Comp' to carry out the selective extraction of an electric load.

In one advantageous alternative embodiment, to transfer a first or second electric load, the number of transfer cycles of lesser electric loads by a load pump is increased when the voltage $V_{CA}$ at the terminals of the auxiliary capacitor increases, so as to extract a substantially constant electric load from the capacitors C1 and C2 per sequence of the regulation method. In a further alternative embodiment where the number of transfer cycles of less electric loads is envisaged as constant, the increase in the voltage $V_{CA}$ generally induces a decrease in the first or second electric load extracted and thus less correction per regulation sequence. However, insofar as the regulation system is configured to be able to readily correct drifts in a standard drift range for the timepiece movement in question, a decrease in the value of the first and second electric loads per regulation sequence, for a given time drift, will induce an increase in regulation sequences per unit of time. The above observations relate to conventional capacitors and also super-capacitors for which the characteristic voltage—electric load curve is substantially linear. On the other hand, it is also possible to envisage by way of secondary storage unit an electric condenser wherein the voltage is subject to little variation, beyond a certain minimum load level, according to the electric load stored. In this case, the electric loads transferred by the load pump(s) are substantially constant regardless of the load level of this secondary storage unit. In such a case, the regulation method described above may vary in relation to the decision to transfer a certain electric load into the secondary storage unit or to consume this electric load in the dissipative circuit envisaged. The regulating device will generally comprise means for determining the filling level of the secondary storage unit.

With the aid of FIGS. 16 to 19 and 20A to 20C, a third embodiment of a timepiece according to the invention shall be described hereinafter. The timepiece movement of this timepiece differs from that shown in FIG. 1 essentially by the configuration of the balance 18*b*, forming the mechanical resonator 6*b*, which bears herein two pairs of bipolar magnets 82 and 84. The teachings previously given which arise again herein shall not be described in detail. That which renders this third embodiment remarkable relative to the first embodiment lies in particular in the choice of the electromagnetic assembly 86 forming the electromagnetic transducer and of the electric converter 72 associated therewith. The electromagnetic assembly comprises two pairs 82 and 84 of bipolar magnets 90 and 91, respectively 92 and 93, which are mounted on a balance 18*b* of the mechanical resonator 6*b* and which have respective magnetization axes which are parallel with the axis of rotation 20 of the balance, and a coil 28 which is rigidly connected to the support of the mechanical resonator.

Figure 16:
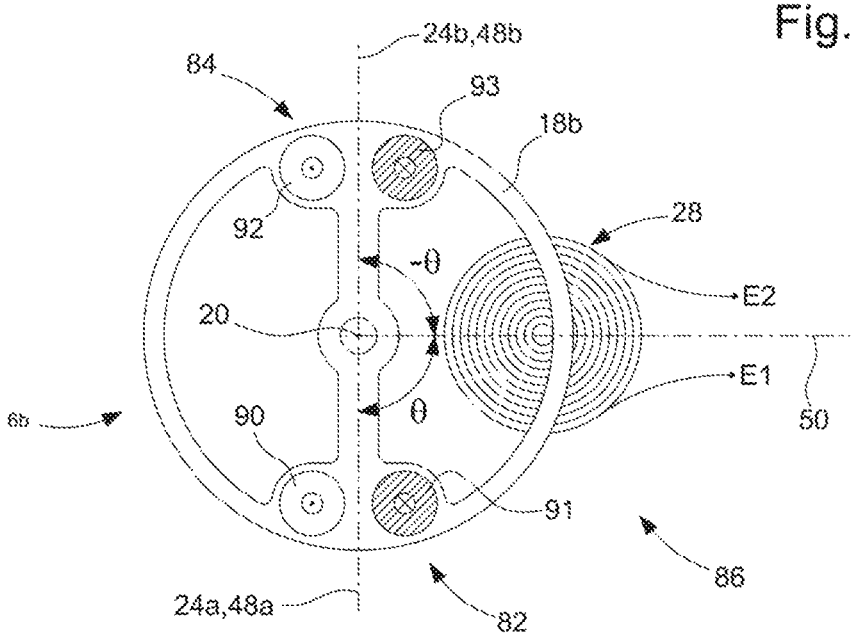
FIG. 16 is a partial view of a third embodiment of a timepiece according to the invention, showing the particular arrangement of the electromagnetic transducer thereof.

Each of the two pairs 82, 84 of magnets, with the two bipolar magnets thereof having opposite respective polarities, is similar to the pair of magnets 22, 23 of the electromagnetic assembly of the second embodiment and the interaction thereof with the coil 28 is identical. Each pair of bipolar magnets defines a median half-axis 24*a*, 24*b* starting from the axis of rotation 20 of the balance and passing via the midpoint of the pair of bipolar magnets in question. Each median half-axis defines a respective reference half-axis 48*a*, 48*b* when the resonator 6*a* is at rest and thus in the neutral position thereof, as shown in FIG. 16. The coil 28 exhibits at the center thereof a first angular lag θ relative to the first reference half-axis 48*a* and a second angular lag—θ (same absolute value as the first angular lag, but opposite mathematical sign) relative to the second reference half-axis 48*a*, so as to induce in each alternation of the mechanical resonator, in an effective functioning range, two central voltage lobes $LUC_1$ and $LUC_2$ having opposite polarities (negative and positive) and substantially the same amplitude $UM_1$, $UM_2$ in absolute values and forming respectively a first voltage lobe and a second voltage lobe (FIG. 20A).

As in the second embodiment, the first and second voltage lobes $LUC_1$ and $LUC_2$ occur respectively in first half-alternations and second half-alternations. Preferably, to poise the balance 18*a*, the first and second angular lags have an absolute value of 90° (alternative embodiment represented in FIG. 16). The two pairs of magnets 82 and 84 are arranged such that the polarities of the magnets of one pair are symmetrical with the polarities of the magnets of the other pair relative to a plane passing via the center of the coil and comprising the axis of rotation 20 (this plane comprising the half-axis 50 passing via the center of the coil and perpendicularly intercepting the axis of rotation 20). It shall be noted that the alternative embodiment of the third embodiment described with reference to the figures is an enhanced alternative embodiment. In a further alternative embodiment which shall not be described in more detail hereinafter, a single pair of magnets is envisaged having an angular lag between 30° and 120° (in absolute values). This further alternative embodiment comprises a regulation circuit without the control 66. The regulation method remains similar and those skilled in the art will be able to adapt it to this particular alternative embodiment.

Figure 20A:
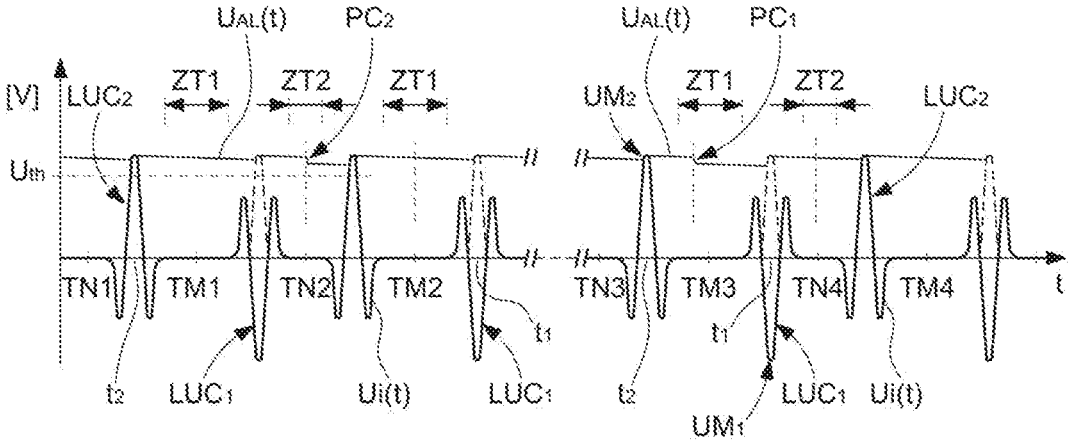
FIGS. 20A to 20C represent various electrical signals arising in the electrical diagram in FIG. 17, and FIGS. 21 and 22 show an advantageous alternative embodiment of a mechanical resonator associated with an electromagnetic assembly of the timepiece according to the invention.
Figure 20B:
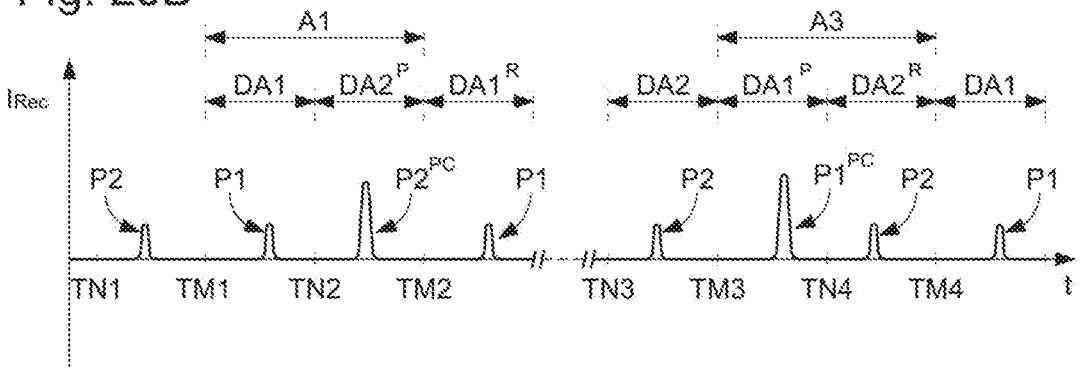

The induced voltage signal Ui(t), represented in FIG. 20A, exhibits alternately voltage lobes $LUC_1$ having a negative voltage and voltage lobes $LUC_2$ having a positive voltage. The electric converter 76 comprises a double-alternation rectifier 78 formed by a bridge of four diodes well-known to those skilled in the art. Thus, at the output of the rectifier 78, the first voltage lobes are rectified, which is represented in FIG. 20A by lobes with broken lines. As in the first embodiment, in the absence of activation of the load pump 60*b*, the first and second voltage lobes $LUC_1$ and $LUC_2$ recharge alternately the power supply capacitor $C_{AL}$ which particularly powers the regulation circuit 74. Given that there are two pairs of magnets, each alternation exhibits a first voltage lobe in a first half-alternation and a second voltage lobe in a second half-alternation. As the signal 'Comp' has two pulses per oscillation period, a control 66 is envisaged upstream from the bidirectional counter CB so as to inhibit one pulse out of every two in the signal supplied to this counter. The alternative embodiment represented in FIGS. 20A and 20C envisages a positive threshold voltage $U_{th}$ whereas the first voltage lobes are negative. The threshold voltage may be chosen as positive or negative. These choices determine the times at which the pulses S2 or S1 occur (see FIG. 10C) in the signal 'Comp' supplied by the comparator 64. Thus, the regulating device comprises a detection device which is arranged to be able to detect the successive appearance of first voltage lobes or second voltage lobes. Note that it is also possible to envisage detecting alternately these first and second voltage lobes using two comparators having as an input respectively a positive voltage threshold and a negative voltage threshold. Those skilled in the art will be able to adapt the regulation method implemented in the logic control circuit 62*b* accordingly, in particular for the determination of the delays $T_{C2}$ and $T_{D2}$.

The load pump device is formed from a load pump 60*b* which defines a voltage booster and which is arranged between the power supply capacitor $C_{AL}$ (primary storage unit) and an electric condenser (secondary storage unit) so as to be able to transfer electric loads from the primary storage unit into the secondary storage unit. The load pump 60*b* quadruples the primary power supply voltage $U_{AL}$ delivered by the primary power supply such that the auxiliary power supply voltage $V_{CA}$ of the electric condenser may be greater, particularly double the voltage $U_{AL}$. The design and functioning of such a voltage booster are well-known to those skilled in the art. The electrical diagram of an alternative embodiment is given in FIG. 18. It comprises four transfer capacitors $C_{Tr}$, two input switches Sw1, six switches 82, three switches 84 and two output switches Sw2. To extract a certain electric load from the capacitor $C_{AL}$, the switches Sw1 and 82 are closed whereas the switches Sw2 and 84 are open (the capacitors $C_{Tr}$ are then arranged in parallel). To subsequently charge the electric condenser $C_{Acc}$, the switches Sw1 and 82 are open whereas the switches Sw2 and 84 are closed (the capacitors $C_{Tr}$ are then arranged in series).

Figure 20C:
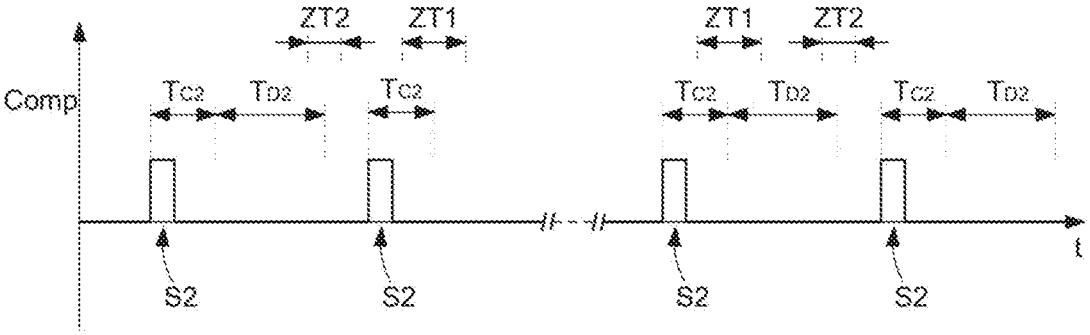

Although the primary storage unit of this third embodiment is identical to that of the first embodiment with a single capacitor $C_{AL}$ which receives all of the induced currents supplied by the electromagnetic transducer, the fact that the electromagnetic assembly 86 is arranged in a similar manner to that of the second embodiment, with the first voltage lobes and the second voltage lobes having opposite polarities, enables the comparator 64 to detect directly either the first voltage lobes, or the second voltage lobes (case represented in FIG. 20A). It is therefore herein not necessary to have to differentiate in the pulses supplied by the comparator those corresponding to the first lobes from those corresponding to the second lobes, which is the reason why there is no time counter CT, but merely a timer associated with the logic control circuit, which may be integrated inside this logic circuit, to measure two delays $T_{C2}$ and $T_{D2}$. In FIG. 20C, it is observed that the signal 'Comp' exhibits merely pulses S2 which each correspond to the appearance of a second voltage lobe $LUC_2$.

Figure 19:
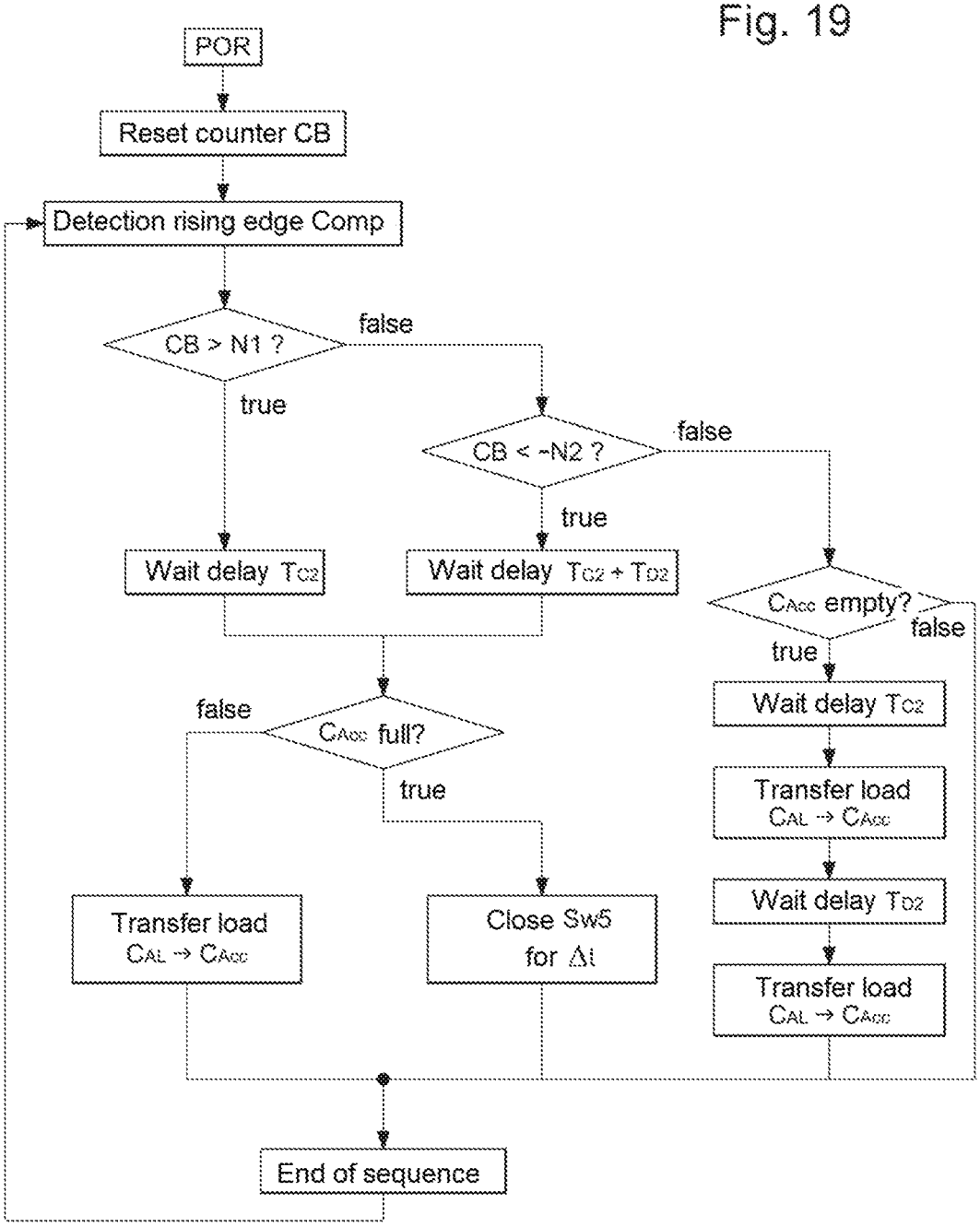
FIG. 19 is a flow chart of a method for regulating the running of the timepiece according to the third embodiment.

FIG. 19 is a flow chart of the regulation method implemented in the logic control circuit 62*b* of the third embodiment. All the features, all the electrical signals and the consequences of the various events that occur shall not be described in more detail, as they ensue from the explanations previously given above and the results are readily understood in the light of these explanations.

Figure 17:
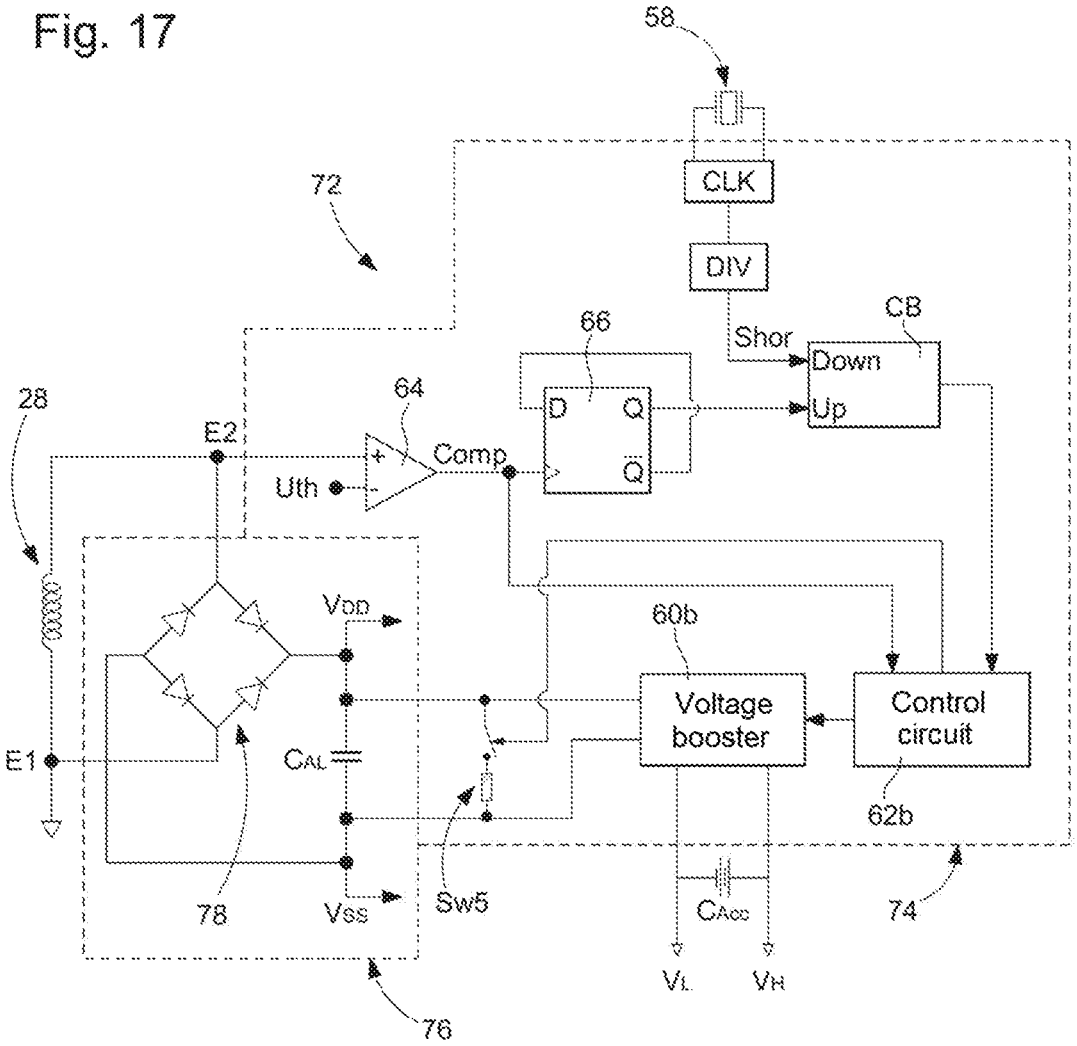
FIG. 17 shows the electrical diagram of the electric converter and the regulating device of the mechanical oscillator as arranged in the third embodiment of a timepiece according to the invention.
Figure 18:
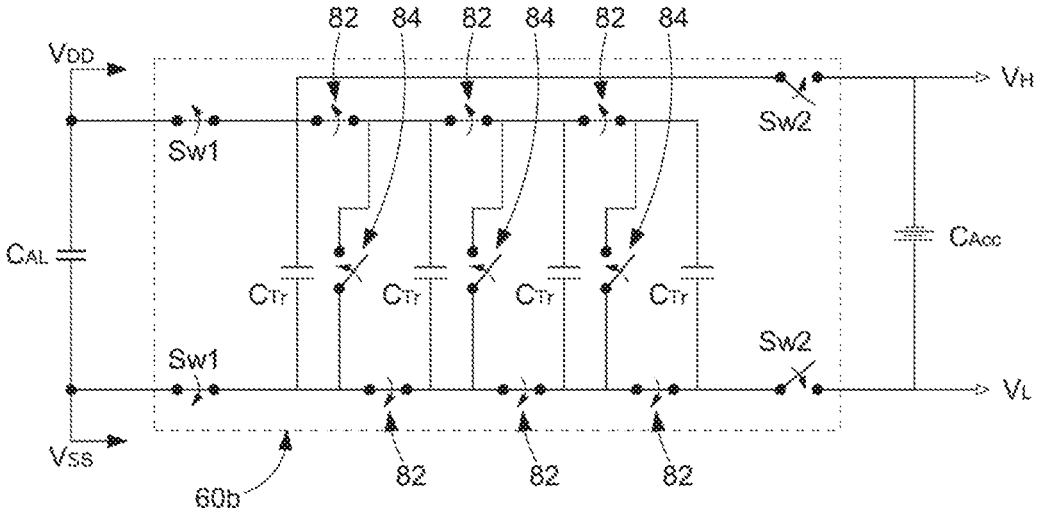
FIG. 18 shows the electronic circuit of an alternative embodiment of a load pump forming the voltage booster of the regulating device represented in FIG. 17.

When the regulation device is started, the regulation circuit 74 is set to 'POR', in particular the bidirectional counter CB. The logic circuit then waits for the appearance of a pulse S2, namely in particular the rising edge thereof in the signal 'Comp'. The detection of this rising edge triggers the timer which measures a first time interval $T_{C2}$ the duration whereof is chosen such that the end thereof occurs in a first time zone ZT1 situated temporally between a second voltage lobe $LUC_2$ and a first voltage lobe $LUC_1$, particularly between the time $t_2$ and the time $t_1$ where these two lobes exhibit respectively the maximum values $UM_2$ and $UM_1$ thereof (FIG. 20A). In parallel, the logic circuit detects whether the value of the bidirectional counter CB is greater than a natural number N1 to determine whether there is a gain in the running of the mechanism in question. If so, the control circuit waits for the end of the delay $T_{C2}$ and, equivalently to the regulation method of the second embodiment, determines whether the electric condenser $C_{Acc}$ is full (i.e. detects whether the electric load storage level thereof is greater than a certain given limit). If the electric condenser $C_{Acc}$ is full, it discharges the power supply capacitor $C_{AL}$ of a first electric load by closing the switch Sw5 of the dissipative circuit comprising a certain resistance and envisaged in parallel with the load pump for a certain time interval Δt (FIG. 17). Otherwise, it transfers a first electric load from the capacitor $C_{AL}$ into the electric condenser $C_{Acc}$ in a first time zone ZT1. Extracting a first electric load induces a descending step $PC_1$ in the power supply voltage $U_{AL}(t)$ and the next induced current pulse $P1^{PC}$ that occurs in a first half-alternation, then has an amplitude greater than that of a pulse P1 in the absence of prior extraction of an electric load (see right-hand section of FIG. 20A to FIG. 20C), such that the mechanical oscillator is then subject to superior braking in the first half-alternation in question.

If the counter CB has a value equal to or less than the natural number N1, then the logic circuit waits for a second delay $T_{D2}$ directly following the first delay $T_{C2}$, coming to an end (FIG. 20C). To do this, from the end of a first time interval $T_{C2}$, the timer starts to measure a second time interval $T_{D2}$. This second delay $T_{D2}$ is chosen such that the end thereof occurs in a second time zone ZT2 situated between a first voltage lobe $LUC_1$ and a second voltage lobe $LUC_2$. In parallel, the logic circuit detects whether the value of the bidirectional counter CB is less than a number−N2, where N2 is a natural number, to determine whether there is loss in the running of the mechanism in question. If so, the control circuit waits for the end of the delay $T_{C2}+T_{D2}$ and determines whether the electric condenser $C_{Acc}$ is full. Depending on whether the condenser is full or not, the control circuit then functions in a similar manner to that described above in the case of gain detection. Extracting a second electric load in the capacitor $C_{AL}$ induces a descending step $PC_2$ in the power supply voltage $U_{AL}(t)$ and the next induced current pulse $P2^{PC}$ that occurs in a second half-alternation, then has an amplitude greater than that of a pulse P2 in the absence of prior extraction of an electric load (see left-hand section of FIG. 20A to FIG. 20C), such that the mechanical oscillator is then subject to superior braking in the second half-alternation in question.

In conclusion, as in the first embodiment, a loss or a gain observed in the running of the mechanism in question is corrected by the selective extraction of an electric load in the capacitor $C_{AL}$ forming the primary storage unit of the regulating device.

The regulation method of the third embodiment further comprises an enhancement linked with the fact that the secondary storage unit powers continuously or intermittently an auxiliary load by delivering an auxiliary power supply voltage $V_{CA}$ to this auxiliary load. Indeed, the auxiliary load is preferably associated with a useful auxiliary function of the timepiece, such that it is desirable to be able to power this auxiliary load. To this end, as shown in the flow chart in FIG. 19, if the counter CB has a value equal to or greater than the number–N2 and a value equal to or less than the number N1, then the control circuit 62*b* determines using suitable means whether the condenser is empty or not. By 'empty', it is understood that the electric load storage level in the condenser $C_{Acc}$ is below a given lower limit and therefore in a scenario no longer capable of providing a satisfactory power supply of the auxiliary function (light-emitting diode, RFID circuit, temperature measurement, North indication (compass function), etc.). Such a scenario arises therefore in the case where no time drift, inducing a correction of the instantaneous frequency of the mechanical oscillator according to the invention, is detected. If this scenario arises and the electric condenser $C_{Acc}$ is empty (in other words, not sufficiently recharged), then the control circuit carries out a recharging operation of the electric condenser by extracting a first load in a first time zone ZT1 and a second electric load, substantially of the same value as the first electric load, in a second time zone ZT2. These two events induce lags in the oscillation of the mechanical resonator which compensate each other, such that a double electric load is transferred from the primary storage unit into the secondary storage unit without inducing a time drift in the running of the timepiece. Once the regulation sequence is complete, the logic control circuit waits for the detection of the rising edge of the next pulse S2 to perform the next regulation sequence.

As previously mentioned, the transfer of a first electric load, respectively of a second electric load may be performed by a plurality of transfer cycles of lesser electric loads by the load pump in the same regulation sequence, in particular in the same time zone ZT1, respectively ZT2. In one alternative embodiment, the logic control circuit is arranged so as to be able to perform, when the time drift measured corresponds to said at least one certain gain, a plurality of extractions of electric loads respectively in a plurality of first time zones during the same regulation sequence. Similarly, when the time drift measured corresponds to at least one certain loss, a plurality of extractions of electric loads respectively in a plurality of second time zones are carried out.

Figure 21:
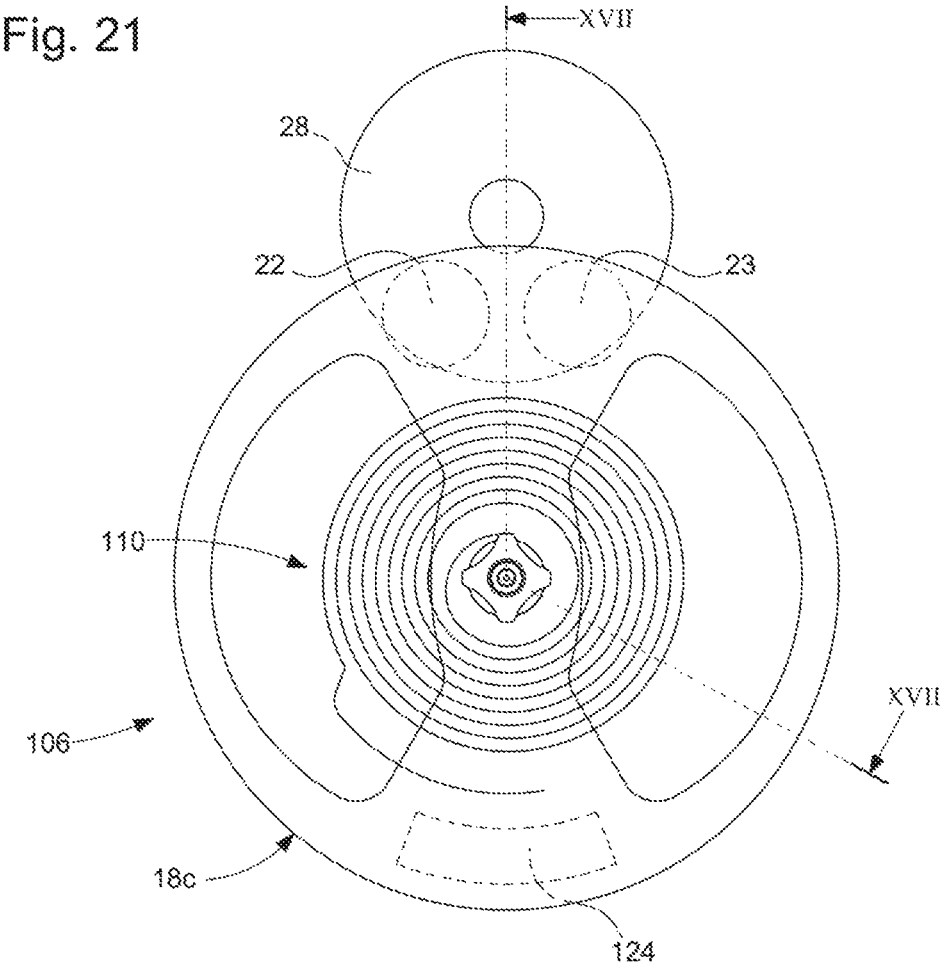
Figure 22:
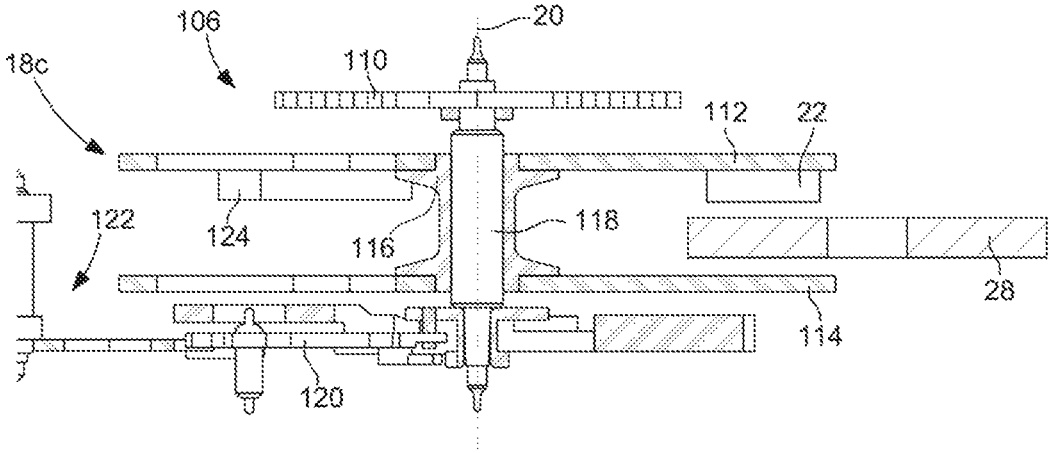

In FIGS. 21 and 22 is shown an advantageous alternative embodiment of a mechanical oscillator 106 incorporated in a movement according to the invention. The resonator 106 is formed by a balance 18*c* which comprises two plates made of ferromagnetic material 112 and 114. The top plate 112 bears on the side of the bottom face thereof the two bipolar magnets 22 and 23. This top plate also serves to close the field lines of the two magnets at the top. The bottom plate 114 serves to close the field lines of the two magnets at the bottom. The two plates of the balance thus form axially a magnetic casing for the two magnets such that the respective magnetic fields thereof remain substantially confined in a volume situated between the respective outer surfaces of these two plates. The coil 28 is arranged partially between the two plates which are fixedly mounted on a cylindrical part 116 made of non-magnetic material, this part being fixedly mounted on an arbor 118 of the balance. In one alternative embodiment, the part 116 may be made of steel and thus conduct a magnetic field, which may an advantage in an alternative embodiment envisaged with a single bipolar magnet, having the magnetic axis thereof axially oriented, on one of the two plates or on each of the two plates. In the latter case, if the cylindrical linking part is non-magnetic, then at least one plate may have one ferromagnetic part which approaches the other or touches same to close the field lines of each magnets via the two plates and thus allow the coil or coils to be traversed axially by substantially the entire magnetic field produced by each magnet when the balance oscillates. It shall be noted further that the plates may be made merely partially from a high magnetic permeability material which forms two parts situated respectively above and below the magnet or, if applicable, the magnets, these two parts being arranged so as allow the coil or, if applicable, the coils of the regulation system to pass therebetween when the balance oscillates.

The resonator 106 further comprises a balance-spring 110 one end whereof is fixed conventionally to the arbor 118. It shall be noted that the balance-spring is preferably made of non-magnetic material, for example of silicon, or of paramagnetic material. In FIG. 22 is also represented an escapement mechanism formed from a pin arranged on a small plate rigidly connected to the balance arbor, pallets 120 and an escapement wheel 122 (shown partially). Under the top plate, opposite the magnets 22 and 23, is envisaged a poising mass 124 of the balance. Further means for performing a fine inertia setting and poising of the balance may also be envisaged. It shall be noted that, in one alternative embodiment, magnets are also borne by the bottom plate. Such magnets are preferably arranged facing the magnets borne by the top plate.

Thus, within the scope of the advantageous alternative embodiment described above, the balance generally comprises a magnetic structure which is arranged so as to define a magnetic casing for the magnet or the magnets borne by the balance while favoring the magnetic coupling of this magnet or of these magnets with the coil or coils envisaged.

The invention claimed is:

1. A timepiece, comprising:

a mechanism, a mechanical resonator suitable for oscillating about a neutral position corresponding to the minimal mechanical potential energy state thereof, each oscillation of the mechanical resonator defining an oscillation period and having two successive alternations each between two extreme positions which define an oscillation amplitude of the mechanical resonator, each alternation having a passage of the mechanical resonator via the neutral position thereof at a median time and comprising a first half-alternation between an initial time of said alternation and the median time thereof and a second half-alternation between said median time and an end time of said alternation, a maintenance device of the mechanical resonator forming with said mechanical resonator a mechanical oscillator which defines a running speed of said mechanism, an electromechanical transducer arranged to be able to convert mechanical power from the mechanical oscillator into electrical power when the mechanical resonator oscillates with an amplitude included in an effective functioning range, said electromechanical transducer being formed by an electromagnetic assembly comprising at least one coil, mounted on a mechanical assembly comprising the mechanical resonator and a support thereof, and at least one magnet mounted on the mechanical assembly, the electromagnetic assembly being arranged so as to be able to supply an induced voltage signal between two output terminals of the electromechanical transducer at least when the mechanical resonator oscillates with an amplitude included in the effective functioning range, an electric converter connected to the two output terminals of the electromechanical transducer so as to be able to receive an induced electric current from said electromechanical transducer, said electric converter comprising a primary storage unit arranged to be able to store electrical energy supplied by the electromechanical transducer, said electromechanical transducer and the electric converter forming a braking device of the mechanical resonator together, a regulating device regulating a frequency of the mechanical oscillator, said regulating device comprising an auxiliary oscillator and a measuring device arranged to be able to detect a potential time drift of the mechanical oscillator relative to the auxiliary oscillator, the regulating device being arranged to be able to determine whether the time drift measured corresponds to at least one certain gain;

wherein the regulating device is arranged to be able also to determine whether the time drift measured corresponds to at least one certain loss; wherein the braking device is arranged such that, in each oscillation period of the mechanical resonator when the oscillation amplitude thereof is in said effective functioning range, the induced voltage signal exhibits a plurality of first voltage lobes occurring at least mostly in a first half-alternation and suitable for generating in said first half-alternation a first induced current pulse to recharge the primary storage unit after a certain extraction of an electric load therefrom and a plurality of second voltage lobes occurring at least mostly in a second half-alternation and suitable for generating in said second half-alternation a second induced current pulse to recharge the primary storage unit after a certain extraction of an electrical load therefrom; wherein the regulating device comprises a load pump arranged to be able to transfer on request a certain electric load from the primary storage unit into a secondary storage unit; and wherein the regulating device further comprises a logic control circuit which receives as an input a measurement signal supplied by the measuring device and which is arranged to be able to activate the load pump device so that, when the time drift measured corresponds to said at least one certain gain, the logic control circuit transfers a first electric load from the primary storage unit into the secondary storage unit such that recharging of the primary storage unit, following the transfer of the first electric load, is generated mostly by at least one first voltage lobe among said plurality of first voltage lobes, the logic control circuit being further arranged to be able to activate the load pump device so that, when the time drift measured corresponds to said at least one certain loss, the logic control circuit transfers a second electric load from the primary storage unit into the secondary storage unit such that recharging of the primary storage unit, following said transfer of the second electric load, is generated mostly by at least one second voltage lobe among said plurality of second voltage lobes.

2. The timepiece according to claim 1, wherein the timepiece comprises a primary load connected or suitable for being regularly connected to the electric converter to be powered by the primary storage unit, the primary load comprising the regulating device.

3. The timepiece according to claim 2, comprises an auxiliary load connected or suitable for being intermittently connected to the second storage unit so as to be able to be powered by said secondary storage unit.

4. The timepiece according to claim 3, wherein the load pump device is arranged so as to form a voltage booster which is arranged so that an auxiliary power supply voltage at the terminals of the secondary storage unit is greater than a primary power supply voltage at the terminals of the primary storage unit.

5. The timepiece according to claim 2, wherein the primary storage unit is formed by a power supply capacitor suitable for being recharged by each first voltage lobe of said plurality of first voltage lobes and said plurality of second voltage lobes after an extraction of an electric load in said power supply capacitor; wherein each first voltage lobe exhibits, in absolute values, a first maximum value at a first time of the corresponding first half-alternation and each second voltage lobe exhibits, in absolute values, a second maximum value at a second time of the corresponding second half-alternation, the plurality of first and second voltage lobes defining, on one hand, first time zones each situated before said first time of a different first voltage lobe and after the second time of a second voltage lobe preceding said first voltage lobe and, on the other, second time zones each situated before said second time of a different second voltage lobe and after the first time of a first voltage lobe preceding said second voltage lobe; and wherein said transfer of the first electric load comprises an extraction of said first electric load from the power supply capacitor in a first time zone among said first time zones and said transfer of a second electric load comprises an extraction of a second electric load from the power supply capacitor in a second time zone among said second time zones.

6. The timepiece according to claim 5, wherein the regulating device further comprises a timer associated with the logic control circuit to enable the latter to activate, if required, the load pump after a first given delay since detection of one of the plurality of first voltage lobes or of one of the plurality of second voltage lobes or after a second given delay since the detection.

7. The timepiece according to claim 5, wherein the load pump device consists of a load pump, said load pump and the logic control circuit being arranged such that the extraction of said first electric load and the extraction of said second electric load from said power supply capacitor are each performed in a plurality of transfer cycles of a lesser electric load between the power supply capacitor and the secondary storage unit by the load pump.

8. The timepiece according to claim 5, wherein the logic control circuit is arranged so as to be able to perform, when the time drift measured corresponds to said at least one certain gain or to at least one given gain greater than the at least one certain gain, a plurality of transfers of first electric loads respectively during a plurality of first time zones and so as to be able to perform, when the time drift measured corresponds to said at least one certain loss or to at least one loss greater than the at least one certain loss, a plurality of extractions of second electric loads respectively during a plurality of second time zones.

9. The timepiece according to claim 5, wherein the electromagnetic assembly comprises a bipolar magnet, mounted on a balance of the mechanical resonator and having a magnetization axis in a geometric plane comprising an axis of rotation of the balance, the at least one coil being rigidly connected to the support of the mechanical resonator and arranged so as to be traversed by the magnetic flux of the bipolar magnet, a median half-axis starting from the axis of rotation of the balance and passing via said axial magnetization axis defining a reference half-axis when the resonator is at rest and thus in the neutral position thereof; and wherein the at least one coil exhibits at the center thereof an angular lag relative to the reference half-axis and said bipolar magnet is arranged on the balance such that mere coupling between said bipolar magnet and the at least one coil can induce in each oscillation period of the mechanical resonator, in said effective functioning range, two voltage lobes of the same polarity which form respectively said first voltage lobe and said second voltage lobe.

10. The timepiece according to claim 9, wherein said angular lag is between 30° and 120° in absolute values.

11. The timepiece according to claim 9, wherein the regulating device comprises a detection device, arranged to be able to detect alternately the successive appearance of said first voltage lobes and said second voltage lobes, and a time counter associated with the logic control circuit to enable the latter to distinguish a first time interval, separating a first voltage lobe from a subsequent second voltage lobe, and a second time interval separating a second voltage lobe from a subsequent first voltage lobe, the first and second time intervals being different due to the arrangement of said electromagnetic assembly.

12. The timepiece according to claim 5, wherein the primary storage unit comprises a first power supply capacitor and a second power supply capacitor, both arranged to be able to power said primary load; wherein the electromechanical transducer is arranged such that the plurality of first voltage lobes each exhibit a first polarity and the plurality of second voltage lobes each exhibit a second polarity opposite the first polarity; wherein the electric converter is formed by a first electrical energy storage circuit which comprises the first power supply capacitor and which is arranged to be able to recharge said first power supply capacitor merely with a voltage having the first polarity at the input of the electric converter and by a second electrical energy storage circuit which comprises the second power supply capacitor and which is arranged to be able to recharge said second power supply capacitor merely with a voltage having the second polarity at the input of the electric converter, a quantity of electrical energy supplied by the braking device to the first power supply capacitor, respectively to the second power supply capacitor increases as a voltage level in absolute values of said first power supply capacitor, respectively of said second power supply capacitor lowers; and wherein the regulating device is arranged such that said transfer of said first electric load consists of a transfer of said first electric load from the first power supply capacitor into the secondary storage unit and said transfer of said second electric load consists of a transfer of said second electric load from the second power supply capacitor into the secondary storage unit.

13. The timepiece according to claim 12, wherein the first and second power supply capacitors have substantially the same capacity value and are arranged to power said primary load jointly.

14. The timepiece according to claim 12, wherein the first and second power supply capacitors are arranged so as to deliver a power supply voltage corresponding to a sum of the respective voltages of said first and second power supply capacitors.

15. The timepiece according to claim 5, wherein the electromagnetic assembly comprises a pair of bipolar magnets mounted on a balance of the mechanical resonator and having two respective magnetization axes which are parallel with a geometric plane comprising an axis of rotation of the balance with opposite respective polarities, the at least one coil being rigidly connected to the support of the mechanical resonator, the pair of bipolar magnets of said pair being arranged on the balance such that the respective magnetic fluxes thereof pass through the at least one coil with a time-lag but with in part a simultaneity of incoming magnetic flux and outgoing magnetic flux such that an induced voltage pulse generated between the two ends of the at least one coil upon the passage of the pair of magnets facing the at least one coil exhibits a central lobe having a maximum amplitude resulting from simultaneous coupling of the two magnets of the pair of magnets with the at least one coil; wherein a median half-axis starting from the axis of rotation of the balance and passing via a midpoint of the pair of bipolar magnets defines a reference half-axis when the resonator is at rest and thus in the neutral position thereof, the at least one coil exhibiting at the center thereof an angular lag relative to the reference half-axis so as to generate in each oscillation period of the mechanical resonator, in said effective functioning range, two central voltage lobes having opposite polarities and forming respectively said first voltage lobe and said second voltage lobe.

16. The timepiece according to claim 15, wherein said angular lag is between 30° and 120° in absolute values.

17. The timepiece according to claim 15, wherein the regulating device comprises at least one detection device, arranged to be able to detect a successive appearance of first voltage lobes and/or second voltage lobes.

18. The timepiece according to claim 1, wherein the regulating device comprises at least one dissipative circuit for dissipating the electrical energy stored in the primary storage unit, at least one switch associated with the dissipative circuit to be able to connect momentarily said dissipative circuit to the primary storage unit and a measurement circuit arranged to detect whether the voltage at the terminals of the second storage unit is greater than a voltage limit or whether a filling level of the secondary storage unit is greater than a filling limit; and wherein the logic control circuit is further arranged so as to be able, when the voltage at the terminals of the secondary storage unit is greater than or equal to the voltage limit or filling limit, to connect momentarily said at least one dissipative circuit to the primary storage unit so as to carry out, when the time drift measured corresponds to said at least one certain gain, a first dissipative discharge of the primary storage unit such that recharging thereof, following said first discharge, is generated mostly by at least one first voltage lobe among said plurality of first voltage lobes, and so as to carry out, when the time drift measured corresponds to said at least one certain loss, a second discharge of the primary storage unit such that recharging thereof, following said second discharge, is generated mostly by at least one second voltage lobe among said plurality of second voltage lobes.

19. The timepiece according to claim 1, comprises a measurement circuit arranged to detect whether the voltage at the terminals of the secondary storage unit is less than a voltage limit or whether a filling level of the secondary storage unit is less than a filling limit; and wherein the logic control circuit is arranged so as to be able, when the voltage at the terminals of the secondary storage unit is less than the voltage limit or filling limit and when the time drift measured is between said at least one certain loss and said at least one certain gain, to activate the load pump device so that it transfers a third electric load from the primary storage unit into the secondary storage unit, such that recharging of the primary storage unit following said transfer of the third electric load is generated mostly by at least one first voltage lobe among said plurality of first voltage lobes, and transfers a fourth electric load from the primary storage unit into the secondary storage unit, such that recharging the primary storage unit following said transfer of the fourth electric load is generated mostly by at least one second voltage lobe among said plurality of second voltage lobes, the fourth electric load being substantially equal to the third electric load.

20. The timepiece according to claim 1, wherein the secondary storage unit is formed by a super-capacitor or an electric condenser.

21. The timepiece according to claim 1, wherein the mechanical resonator comprises a balance-spring; and wherein said maintenance device comprises an escapement kinematically linked to a barrel equipped with a driving spring, the escapement being capable of supplying the balance-spring with a mechanical maintenance torque of the oscillations thereof.

22. The timepiece according to claim 1, wherein said electromagnetic assembly also partially forms the measuring device.

* * * * *